US010772406B2

(12) United States Patent
DeBenedictis et al.

(10) Patent No.: US 10,772,406 B2
(45) Date of Patent: Sep. 15, 2020

(54) HAIR STYLING DEVICE

(71) Applicant: HD3 LIMITED, Birmingham (GB)

(72) Inventors: Alfredo DeBenedictis, Bedford (GB); Martin Malcolm Harris, Birmingham (GB); Janusz Lucien Holland, Birmingham (GB); Mark Christopher Hughes, Clent (GB)

(73) Assignee: HD3 LIMITED, Birmingham (GB)

( * ) Notice: Subject to any disclaimer, the term of this patent is extended or adjusted under 35 U.S.C. 154(b) by 420 days.

(21) Appl. No.: 15/115,686

(22) PCT Filed: Feb. 3, 2014

(86) PCT No.: PCT/GB2014/050296
§ 371 (c)(1),
(2) Date: Jul. 31, 2016

(87) PCT Pub. No.: WO2014/122442
PCT Pub. Date: Aug. 14, 2014

(65) Prior Publication Data

US 2017/0006989 A1 Jan. 12, 2017

(51) Int. Cl.
*A45D 2/38* (2006.01)
*A45D 1/06* (2006.01)
(Continued)

(52) U.S. Cl.
CPC ..... *A45D 2/38* (2013.01); *A45D 1/06* (2013.01); *A45D 1/18* (2013.01); *A45D 7/02* (2013.01); *A45D 1/12* (2013.01)

(58) Field of Classification Search
CPC ..... A45D 2/38–40; A45D 2/46; A45D 1/00; A45D 1/06–14; A45D 1/18; A45D 7/00; A45D 7/02
See application file for complete search history.

(56) References Cited

U.S. PATENT DOCUMENTS 1,609,810 A 12/1926 Gates
1,636,967 A 7/1927 Perry
(Continued)

FOREIGN PATENT DOCUMENTS

DE 172581 C 2/1905
EP 1417906 A1 5/2004
(Continued)

OTHER PUBLICATIONS

"Jan. 6, 2014 Notice of Allowance issued in U.S. Appl. No. 13/740,216 by Rachel Running Steitz".
(Continued)

*Primary Examiner* — Edward Moran
(74) *Attorney, Agent, or Firm* — Hultquist, PLLC; Steven J. Hultquist

(57) ABSTRACT

A hair styling device is described, for waving hair by forming a length of hair into a wave form. A first forming member, a second forming member and a third forming member are located within a chamber of the device. There is a first hair-receiving region between the first and second forming members and a second hair-receiving region between the second and third forming members. A first driving member drives a portion of the length of hair into the first hair-receiving region and a second driving member drives another portion of the length of hair into the second hair-receiving region. The first and second driving members move independently and sequentially so as to reduce the tension applied to the length of hair.

7 Claims, 11 Drawing Sheets

(51) Int. Cl.

| | |
|---|---|
| ***A45D 1/18*** | (2006.01) |
| ***A45D 7/02*** | (2006.01) |
| ***A45D 1/12*** | (2006.01) |

(56) References Cited

U.S. PATENT DOCUMENTS

| | | | | |
|---|---|---|---|---|
| 1,701,270 | A * | 2/1929 | Moskovitz et al. | |
| 1,709,981 | A * | 4/1929 | Headington | A45D 1/04 132/225 |
| 1,806,711 | A | 5/1931 | Salzman | |
| 1,827,785 | A | 10/1931 | Frederics | |
| 1,831,487 | A | 11/1931 | Elam | |
| 1,877,776 | A | 9/1932 | Pezzella | |
| 1,884,305 | A | 10/1932 | Shelton | |
| 1,894,624 | A | 1/1933 | Marcel | |
| 1,895,653 | A | 1/1933 | Fisher | |
| 1,981,362 | A | 11/1934 | Joyce | |
| 2,595,844 | A | 5/1952 | Graham | |
| 2,791,225 | A | 5/1957 | Simmons | |
| 2,867,223 | A | 1/1959 | Anzalone | |
| 2,906,272 | A | 9/1959 | Heidel | |
| 2,935,070 | A | 5/1960 | Auz | |
| 3,213,859 | A | 10/1965 | Mizell et al. | |
| 3,213,860 | A | 10/1965 | Mizell et al. | |
| 3,223,093 | A | 12/1965 | Winters | |
| 3,255,765 | A | 6/1966 | Sturdivant | |
| 3,786,819 | A | 1/1974 | Cantrell | |
| 3,805,810 | A | 4/1974 | Savala | |
| 3,835,292 | A | 9/1974 | Walter et al. | |
| 3,968,805 | A | 7/1976 | Sobeck, Jr. | |
| 4,148,330 | A | 4/1979 | Gnaga | |
| 4,177,824 | A | 12/1979 | Gnaga | |
| 4,222,398 | A | 9/1980 | Fromman | |
| 4,829,156 | A | 5/1989 | Thompson | |
| 4,884,583 | A | 12/1989 | Long, Jr. | |
| 5,119,847 | A | 6/1992 | Powell et al. | |
| 5,472,003 | A | 12/1995 | Frame et al. | |
| 5,584,309 | A | 12/1996 | De Beneditis et al. | |
| 5,771,906 | A | 6/1998 | De Benedictis | |
| 5,813,419 | A | 9/1998 | Brams | |
| 5,899,213 | A * | 5/1999 | Kimata | A45D 1/04 132/225 |
| 6,386,206 | B2 * | 5/2002 | Lee | A45D 1/04 132/225 |
| 6,637,441 | B2 | 10/2003 | Kennedy et al. | |
| 6,647,989 | B1 | 11/2003 | De Benedictis | |
| 6,962,159 | B1 | 11/2005 | Adam | |
| 7,121,285 | B2 | 10/2006 | Kraus | |
| 7,198,049 | B2 | 4/2007 | Elmer et al. | |
| 7,305,995 | B2 | 12/2007 | Tojo et al. | |
| 7,487,783 | B2 | 2/2009 | Saito et al. | |
| 7,500,487 | B2 | 3/2009 | Kobayashi et al. | |
| 7,513,259 | B2 | 4/2009 | Kimata et al. | |
| 7,770,586 | B2 | 8/2010 | Tojo et al. | |
| 7,789,093 | B2 | 9/2010 | Tojo et al. | |
| 8,132,575 | B2 | 3/2012 | Tojo et al. | |
| 8,256,438 | B2 | 9/2012 | Tojo et al. | |
| 8,607,804 | B2 | 12/2013 | De Benedictis | |
| 8,651,118 | B2 | 2/2014 | De Benedictis et al. | |
| 8,733,374 | B2 | 5/2014 | De Benedictis et al. | |
| 8,869,808 | B2 | 10/2014 | De Benedictis | |
| 9,027,570 | B2 | 5/2015 | De Benedictis et al. | |
| 9,138,039 | B2 | 9/2015 | De Benedictis et al. | |
| 2004/0231689 | A1 | 11/2004 | Kobayashi et al. | |
| 2004/0231690 | A1 | 11/2004 | De Benedictis | |
| 2004/0237991 | A1 | 12/2004 | Glucksman et al. | |
| 2005/0241663 | A1 | 11/2005 | Getahun | |
| 2005/0268933 | A1 | 12/2005 | Kimata et al. | |
| 2005/0284493 | A1 | 12/2005 | Allen | |
| 2006/0124148 | A1 | 6/2006 | Tojo et al. | |
| 2006/0157078 | A1 | 7/2006 | Tojo et al. | |
| 2007/0017541 | A1 | 1/2007 | Wilmore | |
| 2007/0065489 | A1 | 3/2007 | Tojo et al. | |
| 2007/0068547 | A1 | 3/2007 | Gurth et al. | |
| 2007/0084479 | A1 | 4/2007 | Ryan-Jakimas | |
| 2008/0035167 | A1 | 2/2008 | Chan | |
| 2008/0236610 | A1 | 10/2008 | Bartels | |
| 2008/0302381 | A1 | 12/2008 | Tojo et al. | |
| 2009/0056738 | A1 | 3/2009 | Tojo et al. | |
| 2010/0083978 | A1 | 4/2010 | Hottenrott et al. | |
| 2010/0170883 | A1 | 7/2010 | Legrain et al. | |
| 2010/0263684 | A1 | 10/2010 | De Benedictis | |
| 2011/0220141 | A1 | 9/2011 | Chan | |
| 2012/0186601 | A1 | 7/2012 | Ungar et al. | |
| 2013/0025621 | A1 | 1/2013 | De Benedictis | |
| 2013/0125919 | A1 | 5/2013 | De Benedictis et al. | |
| 2013/0263882 | A1 * | 10/2013 | Kim | A45D 1/04 132/229 |
| 2014/0076351 | A1 | 3/2014 | De Benedictis et al. | |
| 2014/0216494 | A1 | 8/2014 | De Benedictis et al. | |
| 2015/0000689 | A1 | 1/2015 | De Benedictis | |
| 2015/0128987 | A1 | 5/2015 | De Benedictis et al. | |
| 2015/0201727 | A1 | 7/2015 | De Benedictis et al. | |
| 2015/0216281 | A1 | 8/2015 | De Benedictis et al. | |

FOREIGN PATENT DOCUMENTS

| | | | |
|---|---|---|---|
| EP | 2392222 | A1 | 12/2011 |
| FR | 641097 | A | 7/1928 |
| FR | 38041 | A | 3/1931 |
| FR | 2310105 | A1 | 11/1976 |
| GB | 303043 | A | 12/1928 |
| GB | 1036583 | A | 7/1966 |
| GB | 1157814 | A | 7/1969 |
| GB | 302952 | A | 12/1978 |
| GB | 2413492 | A | 11/2005 |
| JP | S60140502 | U | 9/1985 |
| JP | 61-10102 | U | 1/1986 |
| JP | S6278801 | U | 5/1987 |
| JP | S633808 | A | 1/1988 |
| JP | 2002520076 | A | 7/2002 |
| JP | 2005324073 | A | 11/2005 |
| WO | 0008967 | A1 | 2/2000 |
| WO | 2005082198 | A1 | 9/2005 |
| WO | 2008102317 | A2 | 8/2008 |
| WO | 2008132345 | A2 | 11/2008 |
| WO | 2009077747 | A2 | 6/2009 |

OTHER PUBLICATIONS

"Jan. 29, 2014 Office Action issued in U.S. Appl. No. 13/633,060 by Robyn Kieu Doan".

"Feb. 4, 2015 Notice of Allowance issued in U.S. Appl. No. 14/246,079 by Rachel Running Steitz".

"Mar. 30, 2012 Office Action in U.S. Appl. No. 12/808,646, issued by Robyn Kieu Doan".

"May 15, 2013 Office Action issued in U.S. Appl. No. 13/633,060 by Robyn Kieu Doan".

"Sep. 2012 Office Action in U.S. Appl. No. 12/808,646, issued by Robyn Kieu Doan".

"Sep. 24, 2014 Office Action issued in U.S. Appl. No. 14/246,079 by Rachel Running Steitz".

* cited by examiner

HAIR STYLING DEVICE

CROSS-REFERENCE TO RELATED APPLICATION

This application is a U.S. national phase under the provisions of 35 U.S.C. § 371 of International Patent Application No. PCT/GB14/50296 filed Feb. 3, 2014. The disclosure of such international patent application is hereby incorporated herein by reference in its entirety, for all purposes.

FIELD OF THE INVENTION

This invention relates to a hair styling device, and in particular a hair waving device.

BACKGROUND TO THE INVENTION

A hair styling device is described in WO95/22920, by the present inventor. WO95/22920 discloses a method of styling a length (or tress) of hair by inserting the length of hair into a resilient tube of latex or the like, the tube being stretched lengthwise and the ends of the tube being secured to respective parts of the length of hair. The resilient tube is allowed to contract whereupon the contained length of hair is forced into a wavy form. The hair can be treated before or after insertion into the tube so that the wavy form is maintained after the hair has been removed from the tube.

WO95/22920 also describes a device for use in the method. Improved devices for use in similar hair styling methods are described in the inventor's later applications WO97/46132, WO00/57744, WO00/08967 and WO2012/153118.

All of the above-described documents drive a length of hair into a wavy form and can be described as hair waving devices. The present invention similarly drives a length of hair into a wavy form, but uses an alternative method and an alternative apparatus.

Another type of hair styling device is described in each of WO2009/077747, WO2012/080751 and WO2013/186547. These documents describe devices in which a length of hair is wound around an elongate member so that the length of hair is formed into curls rather than waves.

Hair crimpers also force a length of hair into a wavy form, the crimpers comprising a pair of plates each having a series of corrugations of substantially triangular form. The plates are designed to fit together with the peaks of the corrugations of one plate fitting into the troughs of the corrugations of the other plate, and vice versa. The plates are usually heated so as to style the hair into the desired crimped form. The waves which are created by hair crimpers are typically much smaller in amplitude and wavelength than those created by the methods and apparatus of the patent documents listed above.

A "hair waver" is a product which is similar to hair crimpers in that the hair is clamped between two complementary heated surfaces. In hair wavers the complementary surfaces are usually curved with a relatively large radius of curvature so that the waves in the user's hair are considerably larger than those formed by crimpers. Particular products of this type are referred to as a "jumbo waver" or "deep waver" to emphasise the relatively large size of the waves which are produced in the length of hair.

SUMMARY OF THE INVENTION

The inventors have conceived an alternative apparatus for creating waves in a length of hair, and the present invention is directed to this apparatus, and to a method of use of the apparatus. The apparatus, and thereby the method, has advantages over the known methods and apparatus as set out below.

According to the present invention there is provided a hair styling device for imparting a wave to a length of hair, the device having a chamber for containing the length of hair, a first forming member and a second forming member within the chamber, a first hair-receiving region between the first forming member and the second forming member, a first driving member which is movable relative to the first forming member and the second forming member and which is adapted to drive a portion of the length of hair into the first hair-receiving region.

In its simplest form the device comprises only two forming members and a single driving member and can impart a single wave into a length of hair. In a preferred embodiment, however, there are multiple forming members defining multiple hair-receiving regions, and multiple driving members, so as to impart multiple waves into the length of hair. Specifically, the device can have a third forming member with a second hair-receiving region between the second and third forming members, and a second driving member which is adapted to move between the second forming member and the third forming member whereby in use to drive another portion of the length of hair into the second hair-receiving region. Fourth and fifth etc. forming members can be added to define third, fourth etc. hair-receiving regions, into which further portions of the length of hair can be driven by respective third, fourth etc. driving members.

It is arranged that whilst respective portion of the length of hair are driven into the respective hair-receiving regions, the force required to do so is relatively small. The length of hair is therefore placed under only a small tensile force during the formation of the wave. The avoidance of a large tensile force upon the length of hair reduces the likelihood of damage to the hair.

The chamber is provided to contain the length of hair during the waving process. One or more walls of the chamber may be heated whereby to heat the length of hair during the waving process. In preferred embodiments no part of the length of hair is clamped during the waving process, so that the likelihood of damage to the hair is reduced or avoided. Thus, whilst in some embodiments the length of hair may engage a wall of the chamber during use, the length of hair does not need to be clamped against the wall in order to retain it within the chamber. The provision of a chamber therefore distinguishes the present invention from the prior art hair crimpers and hair wavers which function by clamping the length of hair between heated surfaces.

One embodiment of the device has a first part and a second part, the first part carrying the forming members which comprise a number of first posts, the second part carrying the driving members which comprise a number of second posts, the first part and the second part being movable relative to one another between an inoperative position in which the first posts and the second posts are separated, and an operative position in which the first posts and the second posts have passed one another. The first part and the second part can be located within the chamber, or they can each have walls (or partial walls) so that in the operative position they together define the chamber within which the first posts and the second posts (and the length of hair in use) are located.

Preferably, the driving member(s) and the forming members are identically formed. In such embodiments, a hair-receiving region is provided between each pair of adjacent forming members, and a similar hair-receiving region is also provided between each pair of adjacent driving members. The forming members can therefore act also as driving members, and vice versa.

Preferably, the chamber has an open condition and a closed condition. The chamber ideally has a closure element or panel which serves to close off or obscure an opening through which the length of hair may be introduced into the chamber. A closure element serves three main purposes. Firstly, in embodiments in which the chamber is heated the closure element partly or completely closes the opening and therefore reduces the loss of heat by way of convection through the opening. By retaining more of the heat within the chamber the styling operation can be made quicker and more efficient. Secondly, in those embodiments in which the chamber is heated, the closure element reduces the likelihood of the user touching a heated surface of the device, it being recognised that the heated surfaces can be sufficiently hot to cause significant burns. Thirdly, the closure element reduces the likelihood of extraneous hair being engaged by the moving parts within the chamber which might otherwise cause entanglement and/or discomfort to the user. Specifically, it is desirable that the user introduces a defined length of hair to be styled into the chamber, and that any extraneous hair (which is not part of the defined length of hair but which might lie very close to the opening in practice) is kept out of the chamber by the closure element.

Accordingly, in the open position of the device the user can insert a length of hair into the chamber by way of the opening. Ideally, a hair entry channel is provided between the forming members and the driving member(s), into which the length of hair can be admitted. Preferably, the hair entry channel is substantially linear and lies adjacent to the opening whereby to facilitate ease of introduction of the length of hair into the chamber.

It can be arranged that the driving member(s) and the forming members move to their operative positions relative to one another as the opening is being closed (the movement of the driving member(s) and/or forming members perhaps being mechanically linked to the closure element. Preferably, however, the device is electrically actuated and has a controller which actuates movement of the driving member(s) and/or forming members only after the opening has been closed by the closure element. The latter embodiments ensure that the driving member(s) and/or forming members do not move until the chamber is closed, thereby reducing the likelihood of extraneous hair being engaged by moving parts of the device and perhaps leading to hair entanglement.

Preferably, the chamber is at least partly provided by a body which is mounted upon a first handle part, and the closure element is mounted on a second handle part, the first and second handle parts being movable relative to one another to define an open condition and a closed condition for the chamber, the closure element covering or obscuring the opening in the closed condition. In certain embodiments, the closure element provides a wall of the chamber so that the first and second handle parts carry respective walls of the chamber.

A hair-treatment product can be applied to the length of hair before or after the length of hair has been introduced into the chamber (ideally after the chamber has been closed) whereby to set or style the length of hair in the wavy form. Alternatively or additionally, the length of hair is heated whilst the device is in its closed position whereby to set or style the hair. The chamber may be heated directly by one or more electrical heating elements, by butane gas or other suitable means, or it may be heated indirectly by way of an external hair drier, the heat being transferred to the length of hair by way of the walls of the chamber. The chamber walls may be perforated to allow the externally heated air to engage the length of hair directly.

Preferably, the forming members are arranged in a single line, and the line of forming members is substantially straight. Preferably the driving members are arranged in a single line and the line of driving members is substantially straight.

Desirably, the forming members have a curved surface around which the length of hair is bent during operation of the device. Desirably also, the driving members have a curved surface which is engageable with the length of hair during use. The provision of curved surfaces assists the sliding of the hair past the forming members and driving members as the wave is formed, and thereby minimises the tension in the length of hair. The forming members and driving members can be made of a deformable material so as to minimise any damage to the length of hair. The forming members (and the driving members) may comprise posts of substantially circular cross-section.

In some embodiments of the invention the forming members are fixed in position relative to each other, so that in particular the separation between adjacent forming members is fixed. In such embodiments it is desirable that the gap or spacing between each adjacent pair of forming members is substantially larger than the cross-sectional dimension (e.g. diameter) of the driving members, so that the driving members can pass between adjacent forming members without trapping any of the length of hair therebetween. Preferably, the spacing between adjacent forming members is at least twice the cross-sectional dimension of the driving members. Preferably the cross-sectional dimension of the forming members matches that of the driving members, and the spacing between each pair of adjacent driving members closely matches the spacing between each pair of adjacent forming members.

In other embodiments the second forming member (and also the third, fourth etc. forming members as applicable) is movable relative to the first forming member, so that the size of the first (and second etc. as applicable) hair-receiving region changes during use of the device. Preferably, the size of the hair-receiving region is reduced after, or as, the length of hair has been driven into the hair-receiving region.

Preferably, the path of movement of the driving member(s) relative to the forming members is linear, desirably in a direction substantially perpendicular to the hair entry channel. Alternatively, the path of movement is arcuate. In the alternative embodiments, the forming members and the driving members may be mounted upon respective arms, the arms being connected by a pivot which defines the centre of the arc through which the respective parts move relative to one another.

In embodiments having more than two forming members (and more than one driving member), it can be arranged that the driving members move into the respective hair-receiving regions simultaneously, or sequentially. The latter is preferred as the sequential movement of the length of hair into the respective hair-receiving regions is likely to impart less tension to the length of hair.

In some embodiments there are between three and ten forming members and the same number of driving members. In particular there may be between four and six forming members (and driving members). It is not, however, necessary that the number of forming members and the number of driving members are equal, but if the numbers are not equal it will be understood that in most embodiments the number of forming members should ideally be no more than one greater than the number of driving members. In some embodiments, however, the number of forming members may differ from the number of driving members by two or more.

The device can include a guideway which serves to guide a length of hair into the hair entry channel between the forming members and the driving members. Such an arrangement can benefit a person seeking to style her own hair, particularly in a non-visible position such as the back of the head.

The chamber is preferably defined by a number of walls which together surround the forming members and the driving members (and consequently also surround the length of hair in use) when the device is in the closed condition. Some or all of the walls may be perforated, which is advantageous if the chamber were to be heated indirectly by an external hair drier.

Alternatively, at least some of the walls of the chamber can be replaced by discrete barriers which are positioned adjacent to the respective forming members and/or driving members in order to reduce the likelihood of any part of the length of hair escaping from a hair-receiving region. The discrete barriers thereby help to ensure that the length of hair retains its wave form around the forming members. Thus, it is recognised that it is not necessary for the chamber walls to be continuous in order to retain the length of hair during the waving process, and the chamber can be defined by barriers or wall sections which are positioned to retain the length of hair. Discontinuous walls will also be preferable for those embodiments in which the length of hair is heated by external means such as a hair dryer.

In embodiments in which the heat is applied directly to the chamber, however, for example by heaters within the walls of the chamber (and perhaps also heaters within the forming members and/or driving members), it is preferable for the chamber walls to be substantially continuous whereby to retain as much of the heat as possible. Thus, with the present device the hair is not held against a heated surface as is the case with hair crimpers or hair wavers, and the provision of a substantially enclosed chamber will increase the heat which can be transferred into the hair.

There is also provided a method of using a hair styling device as herein defined, the method comprising the steps of:

{i} inserting a length of hair into the hair entry channel between the first and second forming members and the first driving member;

{ii} moving the first driving member relative to the first and second forming members and driving a part of the length of hair into the first hair-receiving region; and {iii} heating the chamber whilst the length of hair is retained within the chamber.

In many of the described embodiments a single portion of the length of hair is driven into each hair-receiving region. The number of waves which are produced is therefore determined by the number of hair-receiving regions. In an alternative embodiment, more than one portion of the length of hair is driven into one hair-receiving region, so that multiple portions of the length of hair overlie one another in the hair-receiving region.

In a particular embodiment there is provided a hair styling device for imparting a wave to a length of hair, the device having a chamber for containing the length of hair, a first forming member and a second forming member within the chamber, the second forming member being movable relative to the first forming member between an inoperative position and an operative position, a first driving member and a second driving member within the chamber, the first driving member being movable relative to the first forming member between an inoperative position and an operative position, the second driving member being movable relative to the second forming member between an inoperative position and an operative position, a first hair-receiving region between the first and second forming members and a second hair-receiving region between the first and second driving members, the first driving member lying within the first hair-receiving region in its operative position and the second forming member lying within the second hair-receiving region in its operative position.

In such embodiments, the shape of the hair-receiving regions will change as the respective forming member or drive member moves between its inoperative and its operative positions. Preferably, it is arranged that the second forming member moves to its operative position only after the first driving member has moved to its operative position.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
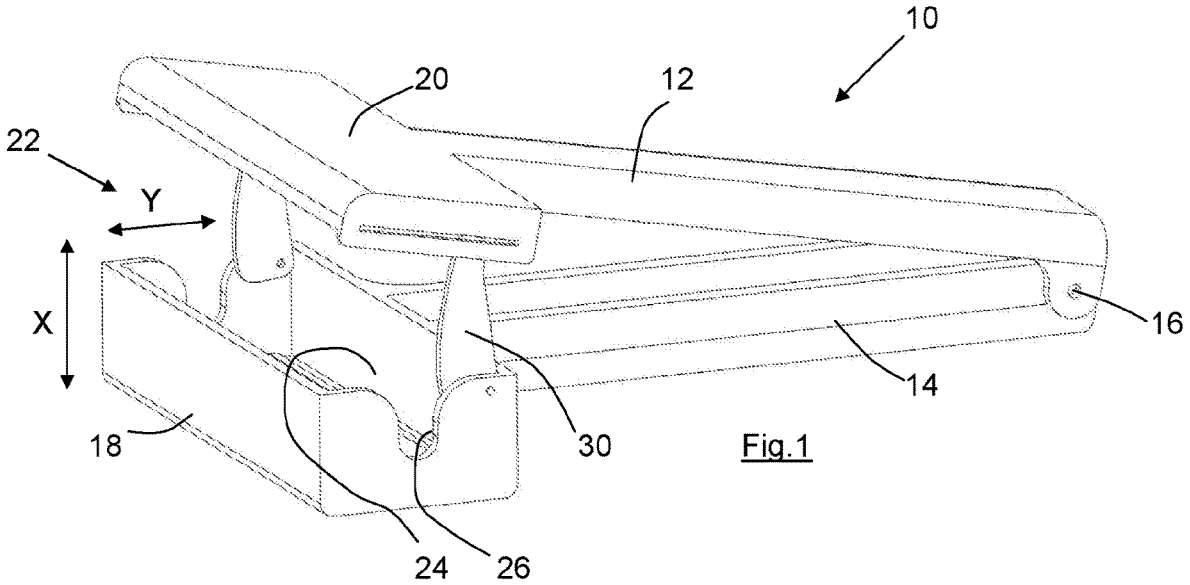
FIG. 1 shows a perspective view of part of a hair styling device according to the present invention, in its open condition.

The hair styling device 10 comprises a first handle part 12 and a second handle part 14, which are pivotably secured together by pivot pin 16. The first handle part 12 carries a body 18 and the second handle part carries a closure element in the form of a panel 20.

Figure 2:
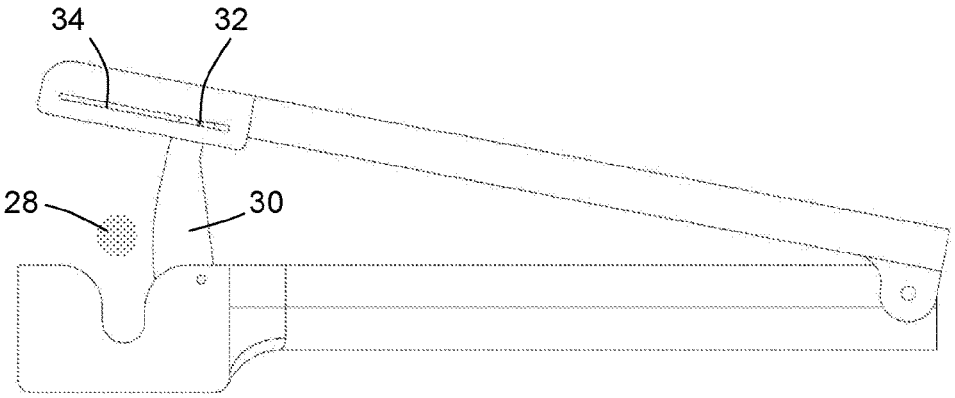
FIG. 2 shows a side view of the device shown in FIG. 1.
Figure 3:
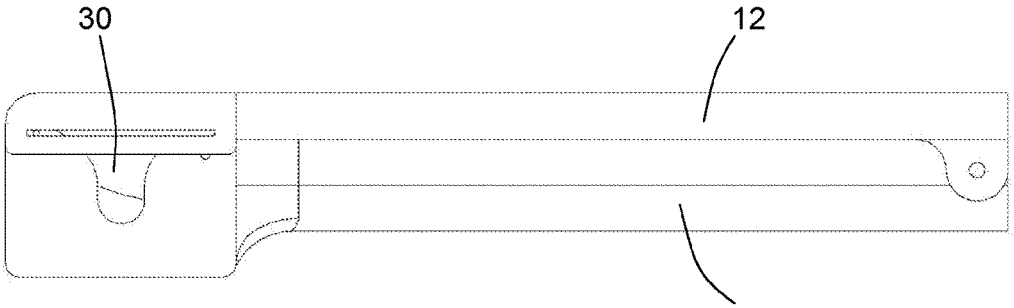
FIG. 3 shows a side view of the device in the closed condition.

FIGS. 1 and 2 show the device 10 in its open condition in which the interior of the body 18 is accessible by way of an opening 22. FIG. 3 shows the device 10 in its closed condition, in which the panel 20 covers and obscures the opening 22, substantially preventing access to the interior of the body 18.

In this embodiment the walls of the body 18 and the panel 20 together define a chamber 24, the chamber being provided to receive and style a length of hair as described below. The end walls of the chamber each have a recess or guideway 26 through which the length of hair 28 can pass into the chamber when the device is closed.

The length of hair 28 which is to be styled lies substantially perpendicular to the plane of the paper in the orientation of FIGS. 2 and 3, and across the body 18 substantially aligned with the guideways 26 in the orientation of FIG. 1.

In order to prevent the length of hair 28 being pushed beyond the guideways 26 (as might occur when a user is unsighted, for example using the device at the back of her head), and perhaps becoming trapped between the handle parts 12, 14, guide members 30 are provided. In this embodiment there are two guide members 30 but in another embodiment only one guide member is provided (for example one of the two guide members 30 may be removed). In yet another embodiment three or more guide members can be provided. The guide members 30 are shown in FIG. 1 to be relatively thin, i.e. they have a relatively small dimension along the length of hair 28, but in alternative embodiments the guide member(s) can be of greater thickness so as to extend a greater distance along the length of hair 28.

The guide members 30 are mounted upon the body 18 and engage the panel 20, but in less preferred embodiments this arrangement could be reversed. It will be understood from FIG. 2 in particular that the user can move the length of hair 28 into engagement with the guide members 30, and then move the length of hair downwards as viewed into the guideways 26. It is expected that with practice a user could introduce a length of hair 28 into the guideways 26 even whilst unsighted, with the guide members 30 providing useful guidance for the insertion of the length of hair.

In this embodiment the guide members 30 are movable, and in particular are pivotably mounted to pivot counterclockwise from the position shown in FIG. 2 to the position shown in FIG. 3, during closure of the panel 20. During this movement, a pin 32 carried by the guide member 30 slides along a channel 34 in the panel 20, as seen by comparing FIGS. 2 and 3. The pivoting movement of the guide members has the additional advantage that the opening 22 through which the length of hair is introduced can be relatively large (see FIG. 2), without significantly increasing the size of the device when closed (see FIG. 3).

Ideally, as explained above the user will introduce the length of hair 28 into the guideways 26 before the panel 20 is closed. If, however, the user does not do so, and for example moves the length of hair only to a position such as that shown in FIG. 2, the guide members 30 can perform the additional function of pressing the length of hair 28 towards, and then into, the guideways 26.

Also, in this embodiment, as seen in FIG. 3 the guide members 30 close off part of the guideways 26 when the device is in the closed condition. It will nevertheless be understood that the guide members 30 do not clamp the length of hair within the guideways 26, and on the contrary the length of hair 28 is still free to move through the guideways 26 and into the chamber 24, as described below.

In another embodiment, the guide members 30 only engage the length of hair during an initial part of the closure movement, following which one or more pressing members provided on the panel 20 engage the length of hair and press it towards, and into, the guideways 26. Since the path of movement of the panel 20 towards the guideways 26 is more linear than the path of movement of the guide members 30, the provision of such pressing members is expected to be advantageous in practice.

Whilst the inventors seek to provide a device with which no part of the length of hair is clamped during use, it is envisaged that clamping a part the length of hair might be acceptable to some users. In one alternative embodiment for example, it can be arranged that a guide member similar to that numbered 30 in FIG. 1 can clamp the length of hair adjacent to the user's scalp whereby to minimise the tension being placed upon the user's scalp during use of the device.

Though not shown in the drawings, one or more of the walls of the body 18, and perhaps also the panel 20, carry heaters (ideally electrical heaters) whereby to heat the chamber 24. The material of the body and panel is preferably thermally insulating so that the external surfaces of the device do not become sufficiently hot to cause damage or discomfort to the user. The closed form of the device when in use effectively prevents the user from touching any of the heated surfaces within the chamber 24.

The chamber 24 in the embodiment of FIGS. 1-3 is substantially cuboid in shape, and is surrounded by six walls which are all substantially planar. In alternative embodiments some of the walls can be curved. Also, two or more of the planar walls of FIGS. 1-3 may be replaced by a single curved wall.

Importantly, FIGS. 1-3 show only a part of the hair styling device, in particular those components providing the chamber within which the length of hair is styled. These figures do not show the components which are located within the chamber 24 and which operate to create the wave in the length of hair 28. FIGS. 1-3 should therefore be considered as representative of a device which can provide a suitable chamber 24 within which to locate the forming members and driving members of the invention, as exemplified in the various embodiments described below. It will be understood that the invention is not limited to the structure shown in FIGS. 1-3, and that some or all of the components of FIGS. 1-3, and the way in which those components interact, can be changed without departing from the scope of the present invention.

All of the embodiments of the device provide (within the chamber 24) two or more forming members which together define at least one hair-receiving region, and one or more driving members, the driving member being movable relative to the forming members so as to drive a portion of the length of hair 28 into the hair-receiving region. The operation is described in more detail in the schematic representations of FIGS. 4-6.

It will be understood that relative movement between the forming members and driving members is required, but it is not important whether {i} the forming members are fixedly mounted within the chamber 24 with the driving members movable relative thereto, {ii} the driving members are fixedly mounted within the chamber 24 with the forming members movable relative thereto, or {iii} the forming members and driving members are each movably mounted within the chamber 24. Thus, notwithstanding that FIGS. 4-6 describe the forming members 40 as stationary and the driving members 42 as movable, the invention is not limited to that arrangement (and similarly for the later-described embodiments).

Figure 4:
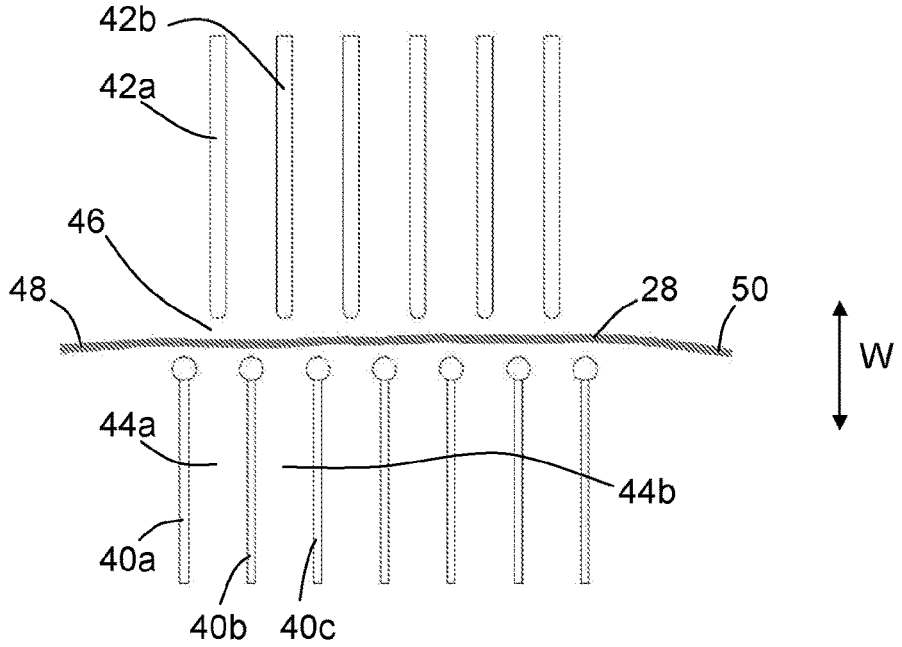
FIG. 4 shows a schematic representation of the forming members and driving members of the invention, in their inoperative positions.
Figure 5:
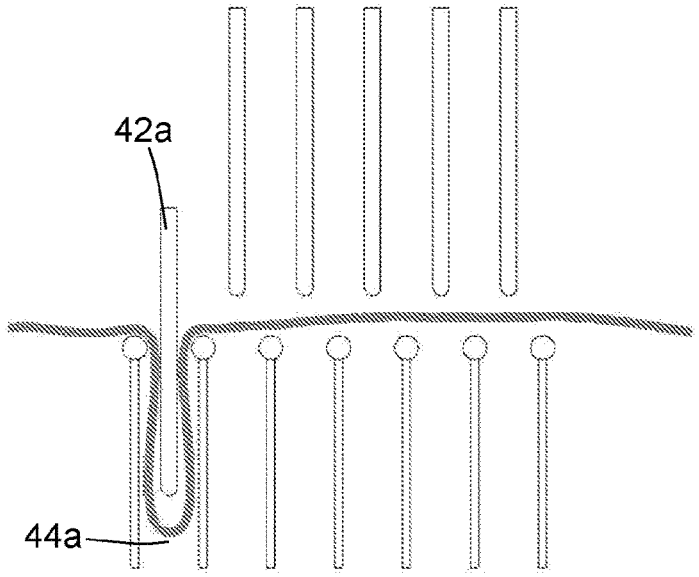
FIG. 5 shows a representation as FIG. 4, with the first driving member in its operative position.
Figure 6:
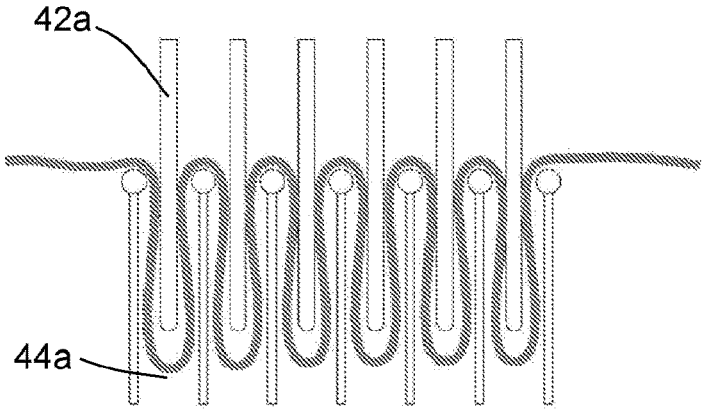
FIG. 6 shows a representation as FIG. 4, but with all of the driving members in their operative positions.

In the arrangement of FIGS. 4-6 there are seven forming members 40, and six driving members 42, but it will be understood that there may be more or fewer of each of these members. The first forming member 40*a* and the second forming member 40*b* provide a first hair-receiving channel or region 44*a* therebetween.

FIG. 4 represents the forming members and the driving members in their inoperative positions. In those positions, a hair entry channel 46 is provided for the introduction of the length of hair 28 between the respective members. In a preferred arrangement, the hair entry channel 46 is aligned with the guideways 26 of the device 10, so that the length of hair 28 can be directly inserted by the user into the hair entry channel 46 between the respective forming members 40 and driving members 42.

As seen in FIG. 5, the first driving member 42*a* can move between the first and second forming members 40*a,b* and into the first hair-receiving region 44*a*. The leading end of the first driving member 42*a* engages the length of hair 28 and drives a portion of the length of hair into the first hair-receiving region 44*a*.

It will be understood that the linear extent of the length of hair within the device when the driving members 42 are in their operative positions of FIG. 6 is considerably greater than that when the driving members are in their inoperative positions of FIG. 4. Typically, the device will be placed close to the user's scalp, and the proximal end 48 of the length of hair 28 will therefore be somewhat fixed in position relative to the device. As the driving members 42 are moved to their operative positions, the distal (free) end 50 of the length of hair 28 is drawn into the device. Since no part of the length of hair 28 is clamped or otherwise secured during use of the device, a further portion of the length of hair is free to be drawn into the device as necessary (through the respective guideway 26), i.e. the distal end 50 is drawn to the left as viewed in FIG. 4.

The ends of the forming members 40, and the ends of the driving members 42, are rounded so as to reduce the likelihood of damage to the length of hair as it moves relative to (i.e. slides past) those members, and also to reduce the frictional resistance to the sliding movement.

FIG. 5 represents the movement of the driving members 42 as sequential, i.e. the first driving member 42*a* drives a portion of the length of hair into the first hair-receiving region 44*a* before the second driving member 42*b* drives another portion of the length of hair into the second hair-receiving region 44*b*, and so on, until all of the driving members 42 have reached their operative positions as shown in FIG. 6. It is desirable that the driving member 42*a* closest to the user's scalp moves to its operative position first so as to minimise the tension upon the proximal end 48 of the length of hair, and thereby reduce any discomfort to the user. Alternatively of course, all of the driving members 42 can move simultaneously from the inoperative position of FIG. 4 to the operative position of FIG. 6, although this is not preferred because it will result in a greater tension being applied to the length of hair 28, and likely greater discomfort to the user.

The device 10 is preferably automated, so that the driving members are actuated to move to their operative positions by way of one or more electric motors for example. The device 10 can include a controller (not shown) which can actuate the driving members only after the chamber 24 has been closed, i.e. the panel 20 is in its closed position of FIG. 3. It will therefore be understood that the likelihood of extraneous hair (i.e. hair which is not part of the length of hair 28) engaging any of the moving parts is much reduced (or effectively eliminated) by the closed chamber 24. The likelihood of entanglement is therefore much reduced.

In automated embodiments, the direction of movement of the driving members 42, i.e. the working direction W, is substantially aligned with the direction Y shown in FIG. 1. In an alternative (manual) embodiment, the driving members 42 are carried by the panel 20 and the forming members 40 are carried by the body 18, so that the driving members are driven (simultaneously) to their operative positions as the handle parts 12, 14 are brought together. In such embodiments, the working direction W is substantially aligned with the direction X of FIG. 1 (i.e. substantially the closing direction of the panel 20). Accordingly, whilst FIGS. 4-6 are described as a schematic representation and are provided primarily for the purposes of explanation, it will be understood that they could represent an embodiment of the invention.

Now that the principle of operation of the invention has been explained, the specific embodiments shown in the drawings will be described.

The first embodiment 110 of FIGS. 7-11 comprises a first part 118 and a second part 120. The first part 118 carries five first posts 140, arranged in a single substantially straight line. The second part 120 carries five second posts 142, also arranged in a single substantially straight line. In this embodiment the first posts 140 and the second posts 142 are identical and interchangeable, so that each of the posts 140, 142 acts both as a forming member and as a driving member, as will be explained below.

The first posts 140 and the second posts 142 are of circular cross-section, each being of the same diameter d. The first posts 140, and similarly the second posts 142, are separated by a gap or spacing s which is substantially larger than the diameter d, and in this embodiment is slightly less than double the diameter d. The first posts 140 are offset from the second posts 142 by a distance approximately half of the spacing s.

Figure 7:
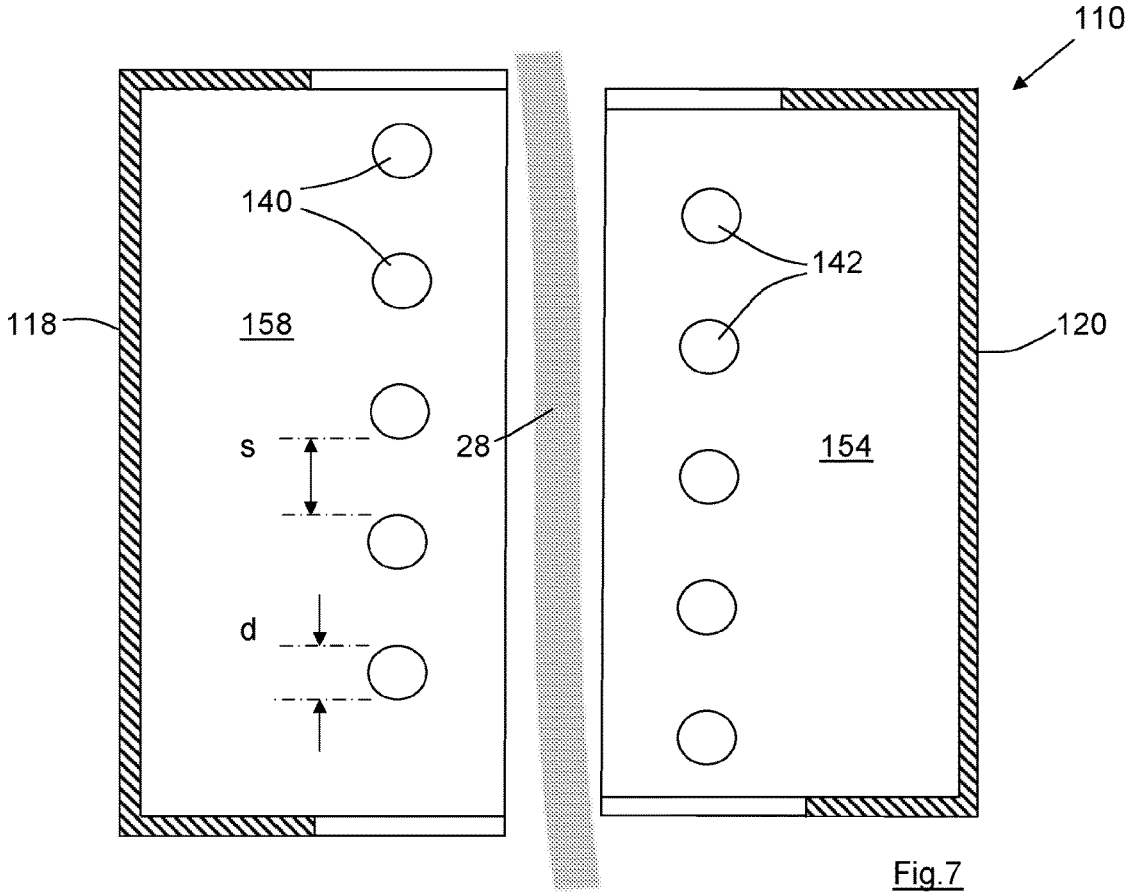
FIG. 7 shows a sectional plan view of a first embodiment of hair styling device according to the invention, with the forming members and driving members in their inoperative positions.

The first part 118 and the second part 120 are shown artificially far apart in FIG. 7, for clarity. In practice, in the inoperative positions the first part 118 and the second part 120 would be connected together (by cooperating sliding surfaces) as shown in FIG. 9.

Figure 8:
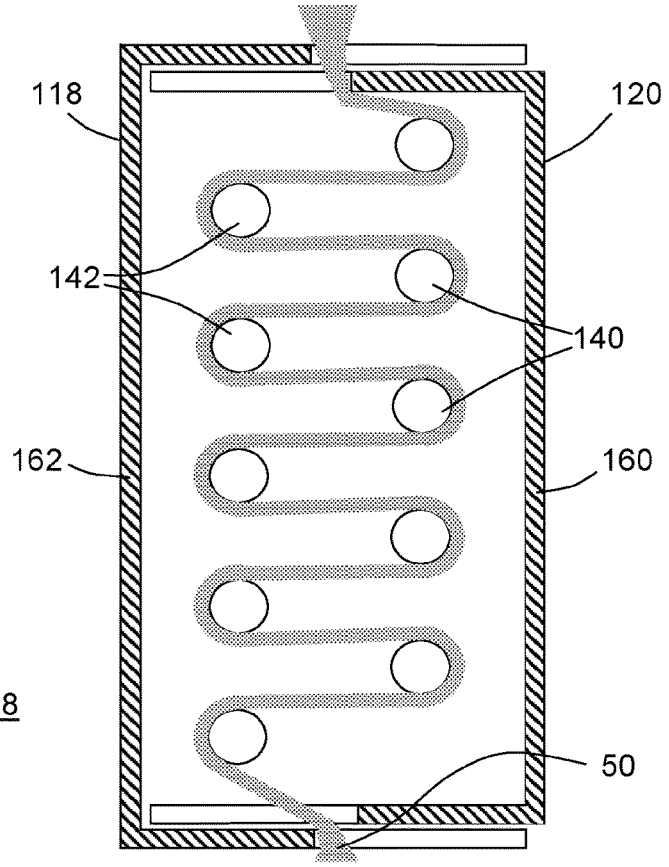
FIG. 8 shows a view of the first embodiment, with the forming members and driving members in their operative positions.

It will be understood that the first part 118 and the second part 120 can each be mounted upon a respective handle part (perhaps pivotable handle parts as in FIGS. 1-3) and be brought together to the closed position of FIG. 8, during which (with the exception of the end-most posts) the first posts 140 pass between an adjacent pair of second posts 142, and vice versa.

Figure 9:
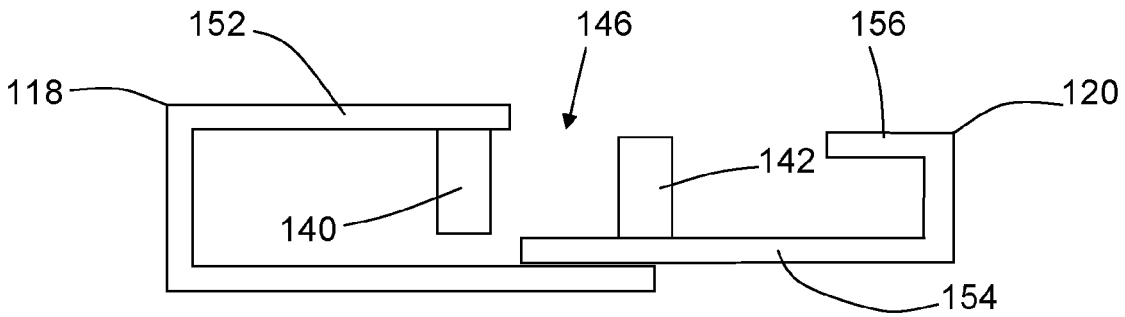
FIG. 9 shows an end view of the first embodiment in an open condition.

Whilst the device 110 is in its open position of FIG. 9, the user can place a length of hair 28 into the hair entry channel 146. As the device is subsequently moved to its closed position of FIG. 8, the first posts 140 and the second posts 142 pass one another, and the length of hair 28 is forced into the wavy form.

It will be understood that the spacing s is significantly greater than the diameter d so that the first posts 140 can readily pass between adjacent second posts 142, and vice versa, without clamping the surrounding hair between the passing posts, thus avoiding damage to the hair.

FIG. 8 shows that the length of hair 28 extends beyond the device 110, i.e. the distal end 50 of the length of hair extends from the device 110 in the operative (closed) position. With a shorter length of hair it may be that the distal end of the length of hair is drawn into the device 10, so that in the closed position the length of hair does not engage all of the posts 140, 142, but that does not affect the operation of the hair styling device 110.

Figure 10:
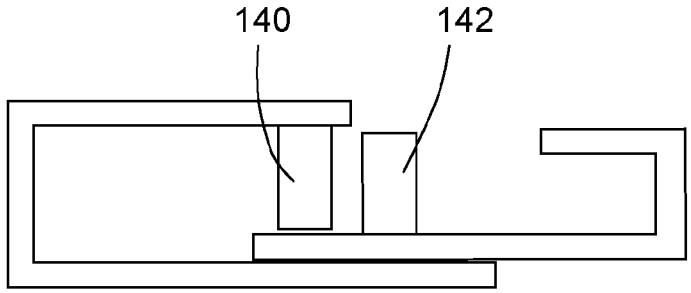
FIG. 10 shows a view as FIG. 3 but in a partially-closed condition.
Figure 11:
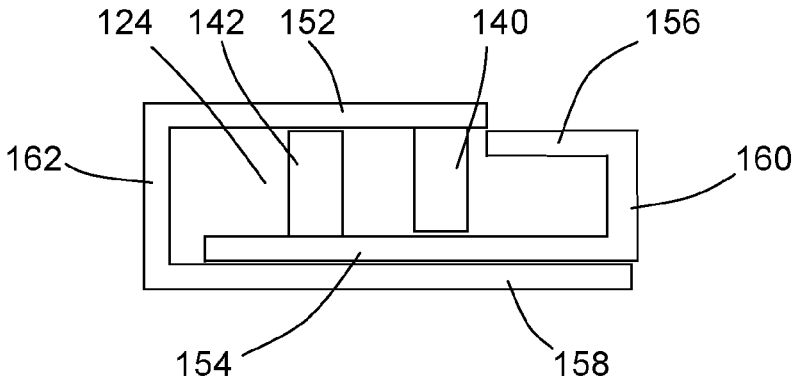
FIG. 11 shows a view as FIG. 3 in a closed condition.

The sequence of operations is also shown in FIGS. 9-11. In FIG. 9 the device 110 is in its open or inoperative position and provides the hair entry channel 146 into which the length of hair 28 may be introduced. Though not shown in this embodiment the device can include one or more guides for the length of hair, for example sloping surfaces aligned with the channel 146, which guide(s) will assist the user in introducing the length of hair into the channel 146 (especially if the user is unsighted).

Following the introduction of the length of hair the first part 118 and the second part 120 are moved together, to the position of FIG. 10. In this position, the length of hair is engaged by the first posts 140 and the second posts 142, and those posts have started to deform the length of hair. Further closing movement of the device 110 causes the first posts 140 to pass the second posts 142 and vice versa, until the operative (closed) position of FIG. 11 is reached.

It will be understood that in the operative position of FIG. 11, the length of hair curls around the left-hand side of the second posts 142, and around the right-hand side of the first posts 140. It is desirable that the parts of the posts 140, 142 which are engaged by the length of hair be curved so as to reduce the likelihood of damage to the hair. It will be understood that the length of hair only engages a part of each post and it is therefore not necessary for the posts to be circular as in this embodiment. The posts could for example be substantially planar as in the representation of FIGS. 4-6.

Since the length of hair is not clamped by the device 110, it is necessary that the length of hair be held in engagement with the posts, i.e. be prevented from passing over the free end of a post and thereby undoing the desired wave form. The first part 118 and the second part 120, when in the closed position of FIG. 11, together provide a chamber 124 for retaining the length of hair, in particular for retaining the length of hair within the hair-receiving regions between the respective posts 140, 142. Thus, whilst in other embodiment the posts 140, 142 are all located within a chamber such as the chamber 24 of FIGS. 1-3, in this embodiment the walls of the first and second parts 118, 120 define the chamber.

The inadvertent escape of the length of hair is prevented by the walls of the chamber 124, and specifically in this embodiment by the wall 152 of the first part 118 which lies close to (and perhaps engages) the ends of the second posts 142 and acts to prevent the length of hair passing around the free ends of the second posts 142. Similarly, the wall 154 of the second part 120 lies close to (and perhaps engages) the ends of the first posts 140 and acts to prevent the length of hair passing around the free ends of the first posts 140.

If desired, the chamber 124 may permit the wavy length of hair to be heated by external means such as a hair drier and thereby styled in the wavy form. This can be satisfied by making the walls 152 and 156 perforated, with relatively large holes or openings, to allow hot air to be blown into the chamber 124. The walls 154 and 158 can similarly be perforated, with the perforations aligned. Alternatively, the chamber can be heated directly, e.g. the walls 152, 154, and perhaps also the walls 156 and 158 can be heated (e.g. electrically).

Alternatively, the chamber can be defined by discrete barriers which prevent the inadvertent escape of the length of hair, i.e. the length of hair can be retained around each of the first posts 140 by discrete fingers projecting from the wall 160 of the second part 120, and similarly the barriers for the second posts 142 can be discrete fingers projecting from the wall 162 of the first part 118. It will be understood that in a plan view similar to that of FIG. 8 such an embodiment would have five fingers projecting from the wall 162, each finger overlying the top end of a second post 142, and would have five fingers projecting from the wall 160, each finger overlying the bottom end of a first post 140. Apart from the projecting fingers, and the walls 152 and 154 upon which the first posts 140 and the second posts 142 are mounted, the chamber 124 could be substantially open to the passage of air.

The first embodiment is described to operate with all of the forming members and driving members moving to their operative positions simultaneously. It is generally preferred to have a progressive or sequential movement so as to minimise the tension within the length of hair. A similar arrangement to that of FIGS. 7-11 could operate progressively by arranging the first part to pivot relative to the second part.

Figure 33:
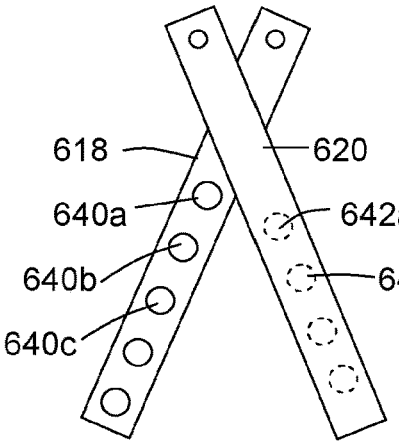
FIG. 32 shows a plan view of the fifth embodiment during a fourth stage of use and FIG. 33 represents an alternative arrangement to the first embodiment, in the inoperative position.
Figure 34:
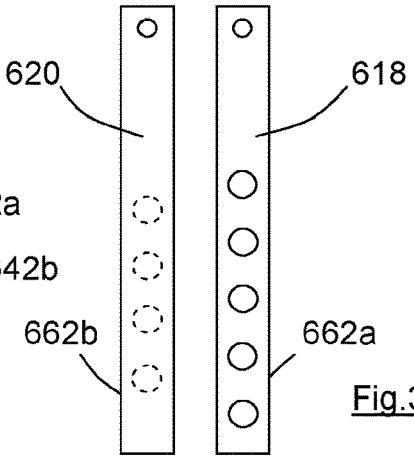
FIG. 34 shows the arrangement of FIG. 33 in the operative position.

Such an arrangement is represented by FIGS. 33 and 34. As the first part 618 is pivoted counter-clockwise as drawn from its position of FIG. 33 to the position of FIG. 34, and the second part 620 is correspondingly pivoted clockwise, it will be understood that the first driving member 642*a* passes between the first and second forming members 640*a,b* before the second driving member 642*b* passes between the second and third forming members 640*b,c*, and so on, resulting in the desired progressive deformation of the length of hair into the desired wavy form. It will be understood that the base plate 662*a* of the first part 618 lies below the base plate 662*b* of the second part 620 in the orientation as drawn, with the forming members and driving members lying between the respective base plates, so that the driving members 642 project into the paper as drawn, whereas the forming members 640 project out of the paper as drawn.

A second embodiment is shown in relation to FIGS. 12-18, it being understood that these figures show the components which might usefully (but not exclusively) be located within the chamber 24 of the device 10 of FIGS. 1-3.

In this embodiment, each of the forming members 240 are separately movable relative to a base plate 262 (the base plate 262 may be the bottom wall of the body 18 for example). The driving members 242 are also separately movable relative to the base plate 262. The forming members (and driving members) may be independently movable, or they may be linked to move sequentially as described below.

As is more apparent from FIGS. 14-18, the forming members 240 and the driving members 242 are mirror-images, but may in other embodiments be identical. These members also perform identical functions and therefore act both as forming members and driving members, although the terms forming members and driving members will continue to be used for consistency.

Figure 12:
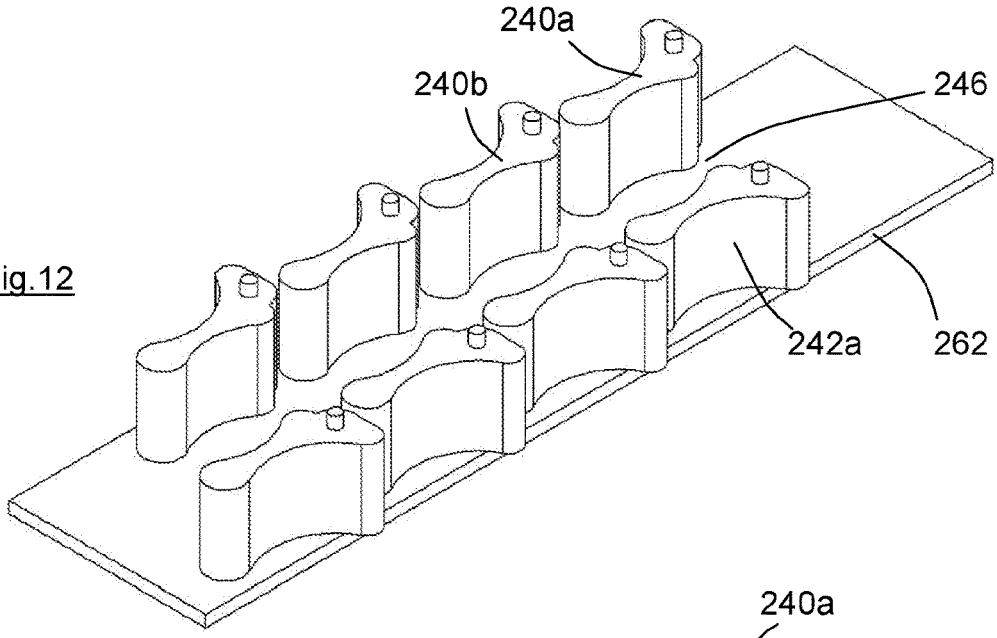
FIG. 12 shows a perspective view of a second embodiment, with the forming members and driving members in their inoperative positions.
Figure 13:
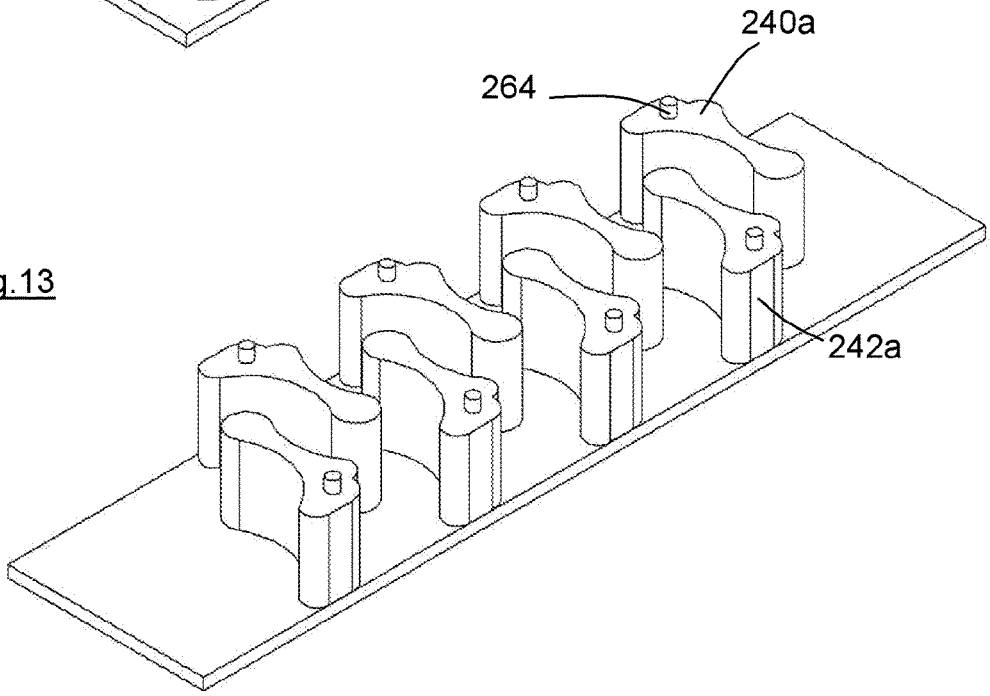
FIG. 13 shows a view as FIG. 12, but with the forming members and driving members in their operative positions.
Figure 14:
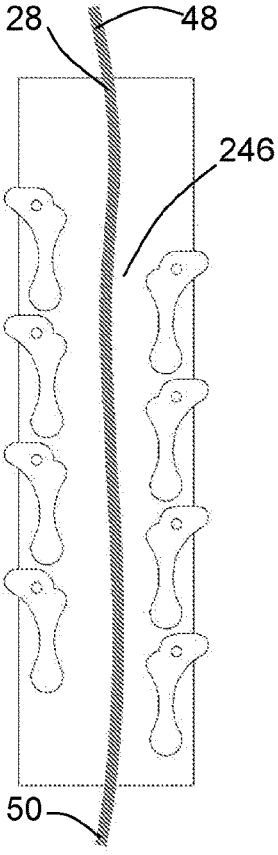
FIG. 14 shows a plan view of the second embodiment during a first stage of use.
Figure 18:
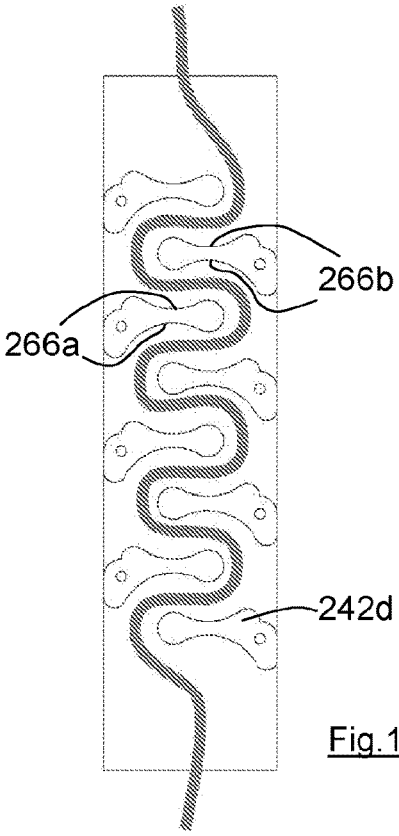
FIG. 18 shows a plan view of the second embodiment during a final stage of use.

In their inoperative positions as shown in FIGS. 12 and 14, the forming members 240 and the driving members 242 together define a hair entry channel 246. The hair entry channel 246 is ideally aligned with the guideways 26 in the device 10. In their operative positions as shown in FIGS. 13 and 18 the members 240,242 define a circuitous channel of a form to produce the desired wave in a length of hair 28.

Figure 15:
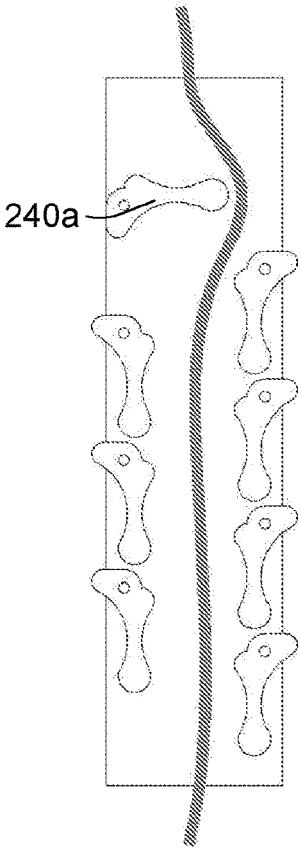
FIG. 15 shows a plan view of the second embodiment during a second stage of use.

The sequence of operations is described in relation to FIGS. 14-18. The length of hair 28 is introduced into the hair entry channel 246 (either placed directly by the user, or pressed by the guide members 30). The first forming member 240*a* then moves to its operative position as shown in FIG. 15, slightly deforming the length of hair 28.

Figure 16:
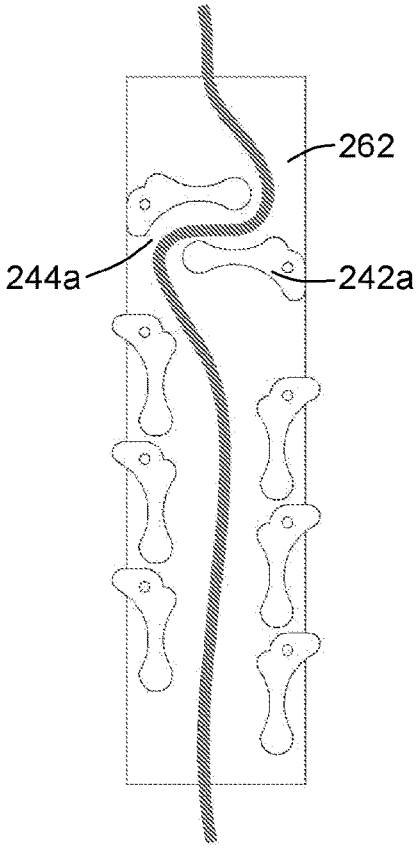
FIG. 16 shows a plan view of the second embodiment during a third stage of use.

The first driving member 242*a* then moves to its operative position as shown in FIG. 16, further deforming the length of hair 28, and in particular further bending a portion of the length of hair around the first forming member 240*a*. The length of hair 28 is shown spaced from the first forming member 240 and the first driving member 242*a* in FIG. 16, though it will be understood that in practice it engages both of those members.

Figure 17:
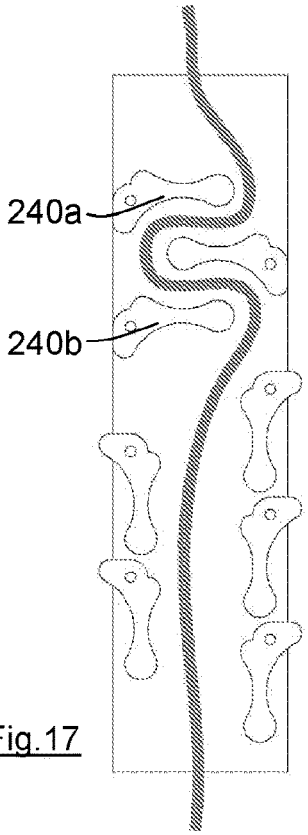
FIG. 17 shows a plan view of the second embodiment during a fourth stage of use.

The second driving member 240*b* then moves to its operative position as shown in FIG. 17, further deforming the length of hair 28, and in particular further bending a portion of the length of hair around the first driving member 242*a*. The procedure is continued until all of the forming members 240 and driving members 242 have reached their operative positions as shown in FIG. 18.

It will be understood that the form of the first hair-receiving region 244*a* which is provided between the first and second forming members 240*a,b* changes as the second forming member moves, and in particular changes after the length of hair has been pressed into the hair-receiving region. Nevertheless, it will be appreciated from FIG. 16 that the first driving member drives a portion of the length of hair into the space between the first and second forming members, and that space is defined as the hair-receiving region, notwithstanding that it subsequently changes shape. The changing shape of the hair-receiving regions is similar for each adjacent pair of forming members 240 (and similarly for each adjacent pair of driving members).

In this embodiment the forming members 240 and the driving members 242 are mounted upon respective pivot pins 264 and rotate through approximately 90° between their inoperative and operative positions. In other embodiments the members rotate through significantly less than 90°, and in yet other embodiments they rotate through significantly more than 90°. In still further alternative embodiments the forming members and driving members are slidable rather than rotatable. If desired, all of the forming members and driving members can rotate together, or their movements can overlap, i.e. the second forming member can commence its rotation before the first driving member has ceased rotating, and so on.

It will be appreciated from FIG. 15 that the tension applied to the length of hair 28 during the movement of the first forming member 240*a* to its operative position is relative small. Similarly, it will be appreciated from FIG. 16 that the tension applied during movement of the first driving member 242*a* is also relatively small. The tension applied during the movement of each forming member, and each driving member, is likewise small, so that the sequential operation as described in relation to this embodiment is particularly beneficial in minimising the tension applied to the length of hair.

Furthermore, if the wave is applied from the proximal (scalp) end of the length of hair 28, the force applied to the user's scalp, and therefore the discomfort felt by the user, is minimised, i.e. little or no tension is applied to the proximal end 48 of the length of hair during the later stages of operation. Alternatively stated, it is expected that after the second forming member 240*b* has been moved to its operative position (and perhaps even after the first driving member 242*a* has been moved to its operative position), further movement of the forming and driving members will simply draw in more of the length of hair 28 from its distal end 50 rather than seeking to draw in hair from the proximal end 48.

FIG. 18 represents the position shortly after the fourth driving member 242*d* has reached its operative position. It will be understood that the length of hair 28 is still under a small amount of tension whilst the fourth driving member 242*d* is moving. The natural resilience of the length of hair 28 will, however, act to return it to a substantially linear condition, so that each portion of the length of hair will seek to expand into engagement with the forming members or driving members which surround it (in turn drawing more hair into the device). It will be seen that the side edges 266*a,b* of the forming members 240 and driving members 242 are all arcuate (and ideally part-circular) and that together the adjacent forming and driving members provide cooperating part-circular walls whereby to allow the length of hair to follow a smooth curve within the device, and thereby produce a smooth wave.

FIGS. 12-18 have forming members 240 and driving members 242 with side edges 266*a,b* which are substantially perpendicular to the plane of the base plate 262. The formed wave is therefore two-dimensional, i.e, the formed wave shown in FIG. 18 is substantially flat and parallel to the plane of the paper in FIGS. 14-18. In an alternative embodiment the side edges 266*a,b* can be angled relative to the plane of the base plate 262 whereby to produce a three-dimensional wave.

Specifically, the forming members 240 can be tapered so that the respective side edges 266*a* converge away from the base plate 262, and the driving members 242 can be oppositely tapered so that their side edges 266*b* diverge away from the base plate 262. The effect of this is that the length of hair 28 is urged towards the base plate 262 where it engages the driving members 242, and is urged away from the base plate 262 where it engages the forming members 240. In a plan view similar to that of FIG. 18 for this alternative embodiment, the length of hair 28 will have a wave to the left and right as viewed (as in FIG. 18), and will also have a wave into and out of the paper as viewed.

It will be appreciated from FIGS. 14-17 that the forming members 240 and driving members 242 in their inoperative positions each project slightly beyond the base plate 262. The projections provide respective cams which can be engaged by an actuator which is driven along the edge of the base plate 262 in order to move the members sequentially to their operative positions. The members can be resiliently biased towards their inoperative positions so that the return movement of the actuator is automatically accompanied by the movement of the forming and driving members back to their inoperative positions.

The third embodiment is shown in FIGS. 19-22. In this embodiment the forming members 340 are carried by respective arms 368, each of which is mounted on a single pivot peg 370. Similarly, the driving members 342 are carried by respective arms 372, each of which is mounted on a single pivot peg 374. The forming members and the driving members are movable from the inoperative position shown in FIGS. 19 and 21 to the operative position of FIGS. 20 and 22. The movement is preferably sequential and similar to the operation of the third embodiment described above, but the movement could less preferably be simultaneous.

In an alternative embodiment the forming members (and similarly the driving members) could be mounted upon separate pivot pegs.

Figure 19:
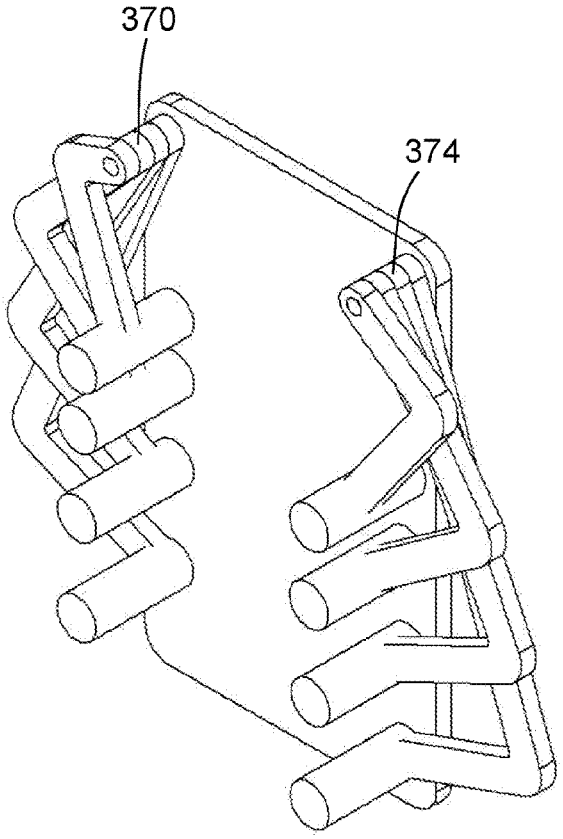
FIG. 19 shows a perspective view of a third embodiment, with the forming members and driving members in their inoperative positions.
Figure 20:
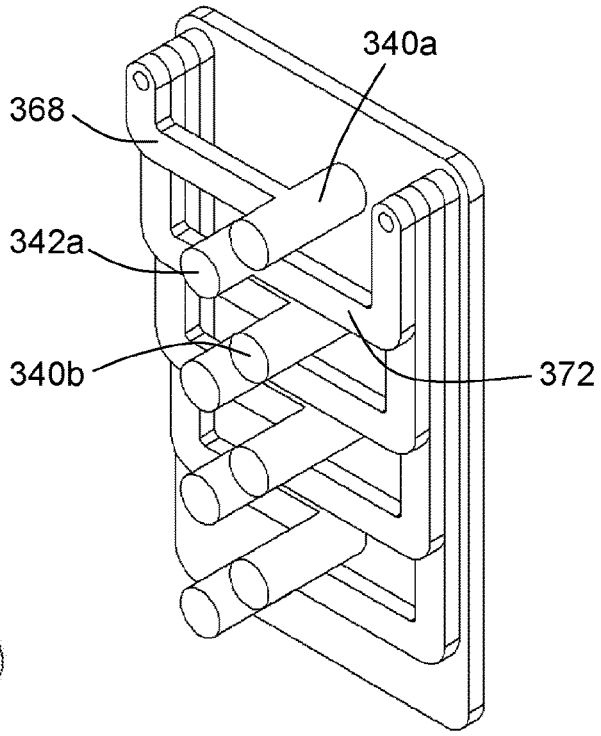
FIG. 20 shows a view as FIG. 19, but with the forming members and driving members in their operative positions.
Figure 21:
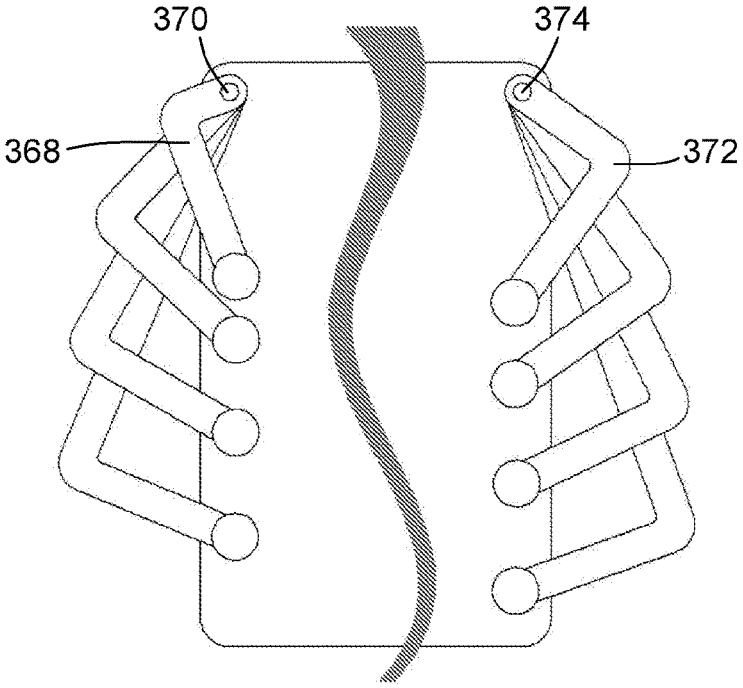
FIGS. 21 and 22 show plan views of the third embodiment during a first stage of use and a final stage of use, respectively.
Figure 22:
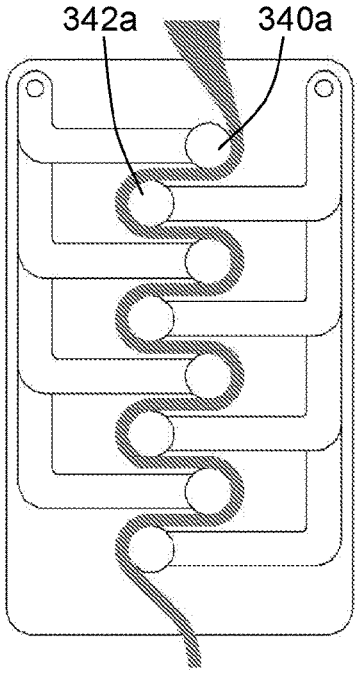

It will be seen from FIG. 19 in particular that the arms 368 and 372 are offset so that they can partially overlie one another. In this embodiment the forming members 340 and the drive members 342 are all positively driven to their respective operative positions by actuators (not shown). In an alternative embodiment the forming members 340 may be engaged by the arm 372 of the adjacent drive member 342, and the drive members 342 may be engaged by the arms 368 of the adjacent forming member 340, the engaging arms at least partially driving the members to their operative positions.

The fourth embodiment is shown in FIGS. 23-27. This embodiment differs from the previous embodiments in that the driving member(s) are provided by a continuous spiral member 442 which rotates in the direction shown in FIG. 25, and also moves along the line of forming members 440 in the direction shown in FIG. 25. The pitch of the spiral member 442 closely matches the separation between adjacent forming members 440.

Figure 23:
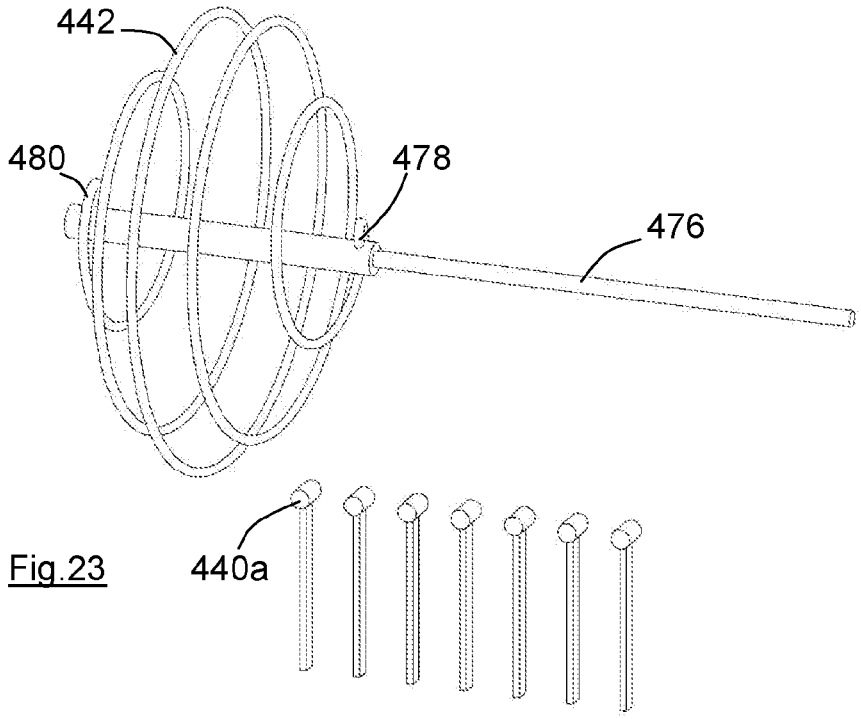
FIG. 23 shows a perspective view of a fourth embodiment, with the forming members in the inoperative position.
Figure 24:
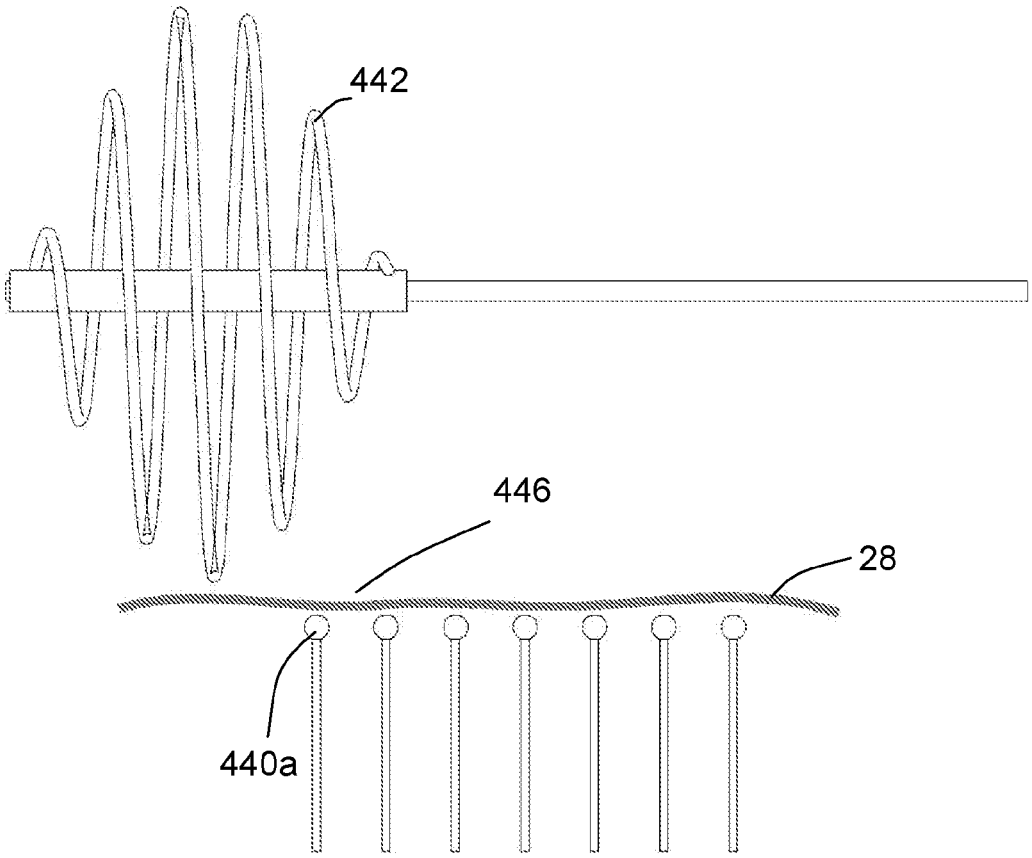
FIG. 24 shows a plan view as FIG. 23.

In the inoperative position of FIGS. 23 and 24, the length of hair 28 is placed into the hair entry channel 446 between the line of forming members 440 and the spiral member 442. The spiral member 442 is then moved until its leading end 478 lies close to the portion of the length of hair adjacent to the first hair-receiving region 444*a* provided between the first and second forming members 440*a,b*.

Figure 25:
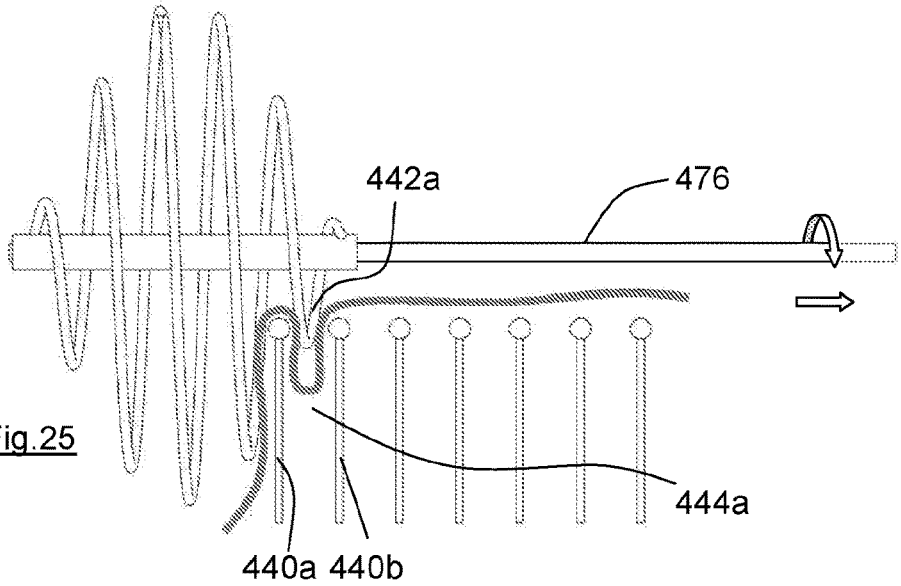
FIG. 25 shows a plan view of the fourth embodiment during an initial stage of use.

The spiral member 442 is then rotated by way of the axle 476, and is also moved to the right as drawn (the linear movement corresponding to the rate of rotation and the pitch of the spiral). It will be observed that the radius of the spiral member 442 increases gradually from its leading end 478, and the spiral member 442 therefore engages the length of hair and begins to drive a portion of the length of hair into the hair-receiving region as shown in FIG. 25. Further rotation (and movement) of the spiral member 442 causes more of the length of hair to be driven into the first hair-receiving region 444*a*.

Figure 26:
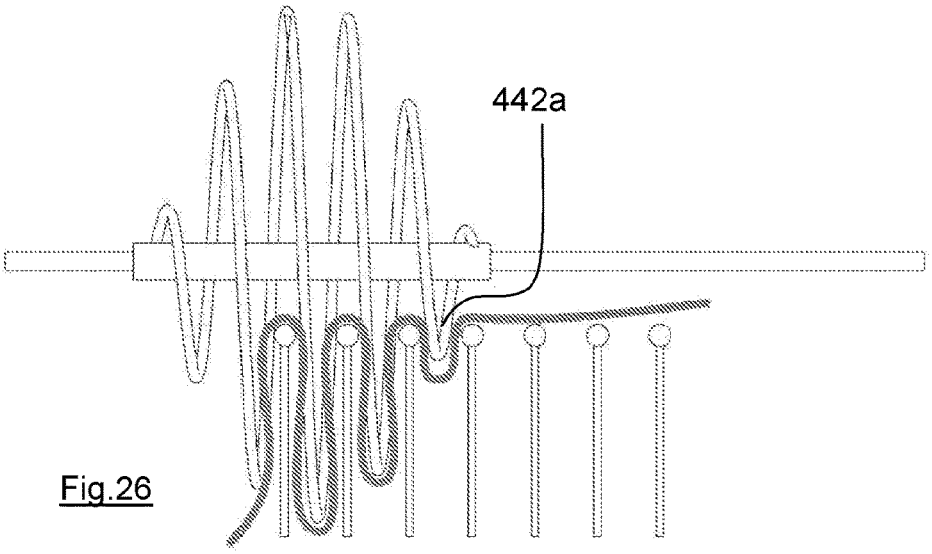
FIGS. 26 and 27 show plan views of the fourth embodiment during a later stage of use and a still later stage of use, respectively.

The rotation and linear movement continue to the position of FIG. 26 with successive coils of the spiral member 442 pressing respective portions of the length of hair 28 into successive hair-receiving regions.

It will be seen that the radius of the coil decreases gradually to its trailing end 480, so that the coiled member 442 is symmetrical. It will therefore be understood that the coils between the mid-point (having maximum radius) and the trailing end 480 do not act to press the length of hair, but act to retain the hair in the respective hair-receiving regions. Thus, the later coils engage the length of hair sufficiently to prevent the length of hair being pulled out of the first hair-receiving region 444*a*, for example.

Figure 27:
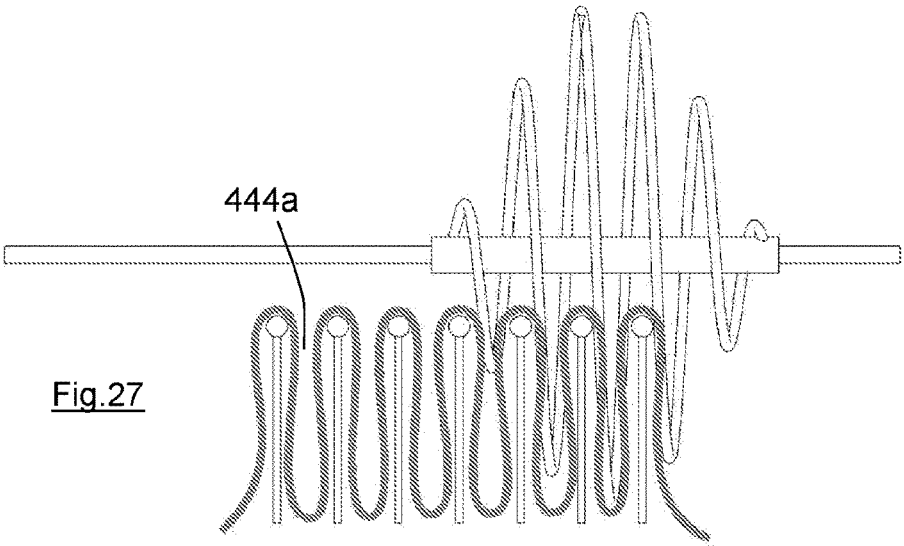

Alternatively stated, the force required to draw more hair into the device is smaller than the force required to pull any of the existing hair out of a hair-receiving region. The portions of the length of hair which have been introduced into the hair-receiving regions are therefore retained as the spiral member 442 approaches the end of its travel as shown in FIG. 27. If desired, however, the coil could in alternative embodiments be asymmetrical and maintain its maximum radius up to its trailing end.

It will be understood that the fourth embodiment also differs from the earlier embodiments in applying a force to the length of hair which is substantially perpendicular to the forming members 440, i.e. the coil exerts a small frictional force upon the length of hair in the direction into the paper as viewed in FIG. 25. One or more resilient flaps (not shown) can be located adjacent to the forming members 440, which will allow the rotation of the spiral coil 442 but will retain the length of hair in contact with the forming members. Also, the forming members can be made significantly wider (in the direction into the paper in FIGS. 24-27) than is represented in FIG. 23, in order to avoid the likelihood of the length of hair becoming separated from a forming member.

The fifth embodiment is shown in FIGS. 28-32. In the earlier embodiments a separate hair-receiving region is provided for different portions of the length of hair. The fifth embodiment differs in that multiple portions of the length of hair are driven into each of the two hair-receiving regions provided.

Figure 28:
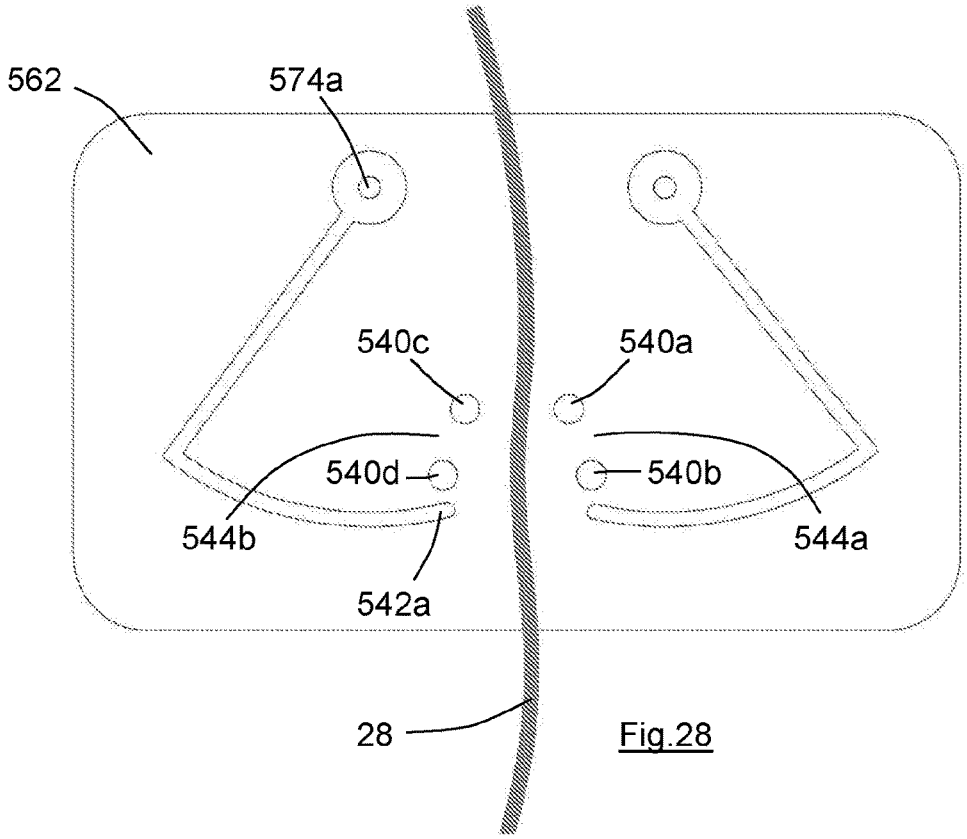
FIG. 28 shows a plan view of a fifth embodiment, with the driving members in their inoperative positions.

The fifth embodiment comprises a first and second forming member 540*a*, 540*b*, each of which comprises a post rigidly secured to a base plate 562 (which base plate may be the bottom wall of the body 18 for example). There is a gap between the first and second forming members which provides a first hair-receiving region 544*a*. A first driving member 542*a* is pivotably mounted upon pivot peg 574*a* and can move from an inoperative position as seen in FIG. 28 to an operative position as seen in FIG. 29.

Figure 29:
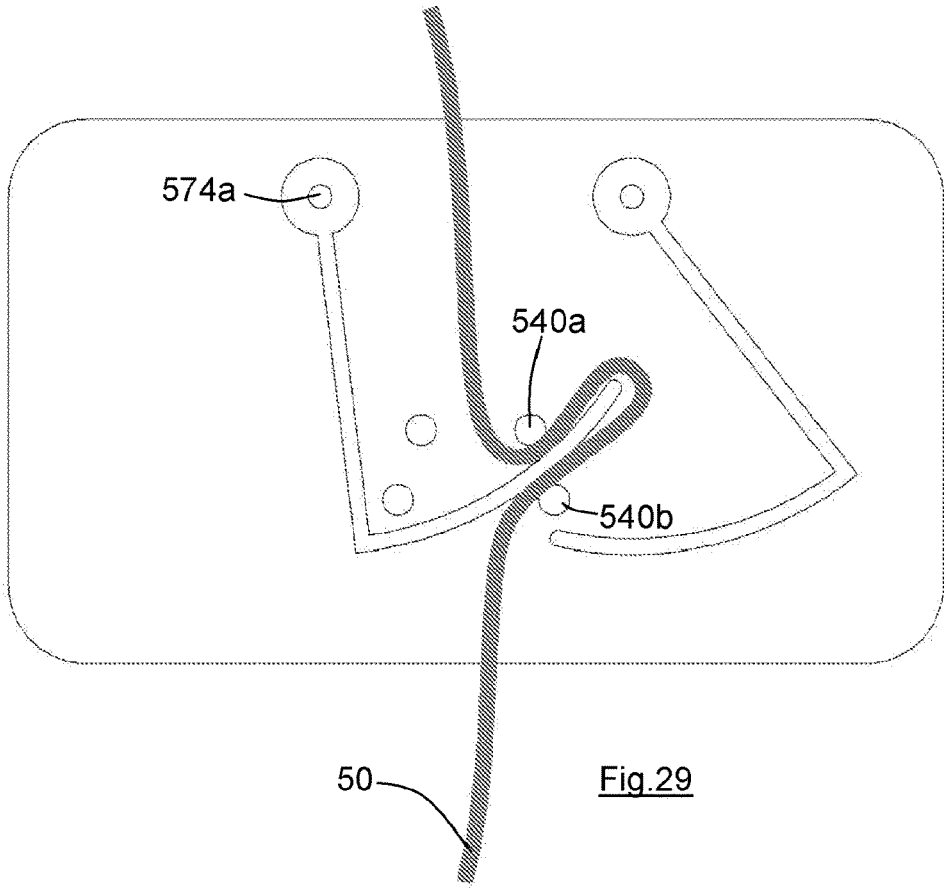
FIG. 29 shows a plan view of the fifth embodiment during an initial stage of use.

It will be understood from FIG. 29 in particular, that the driving member 542*a* is arcuate with a radius of curvature similar to the distance between the pivot peg 574*a* and the first hair-receiving region 544*a*. Accordingly, the first driving member 542*a* can rotate about its pivot peg from its inoperative position to its operative position and drive a portion of the length of hair 28 into the first hair-receiving region 544*a* between the first and second forming members 540*a,b*.

Figure 30:
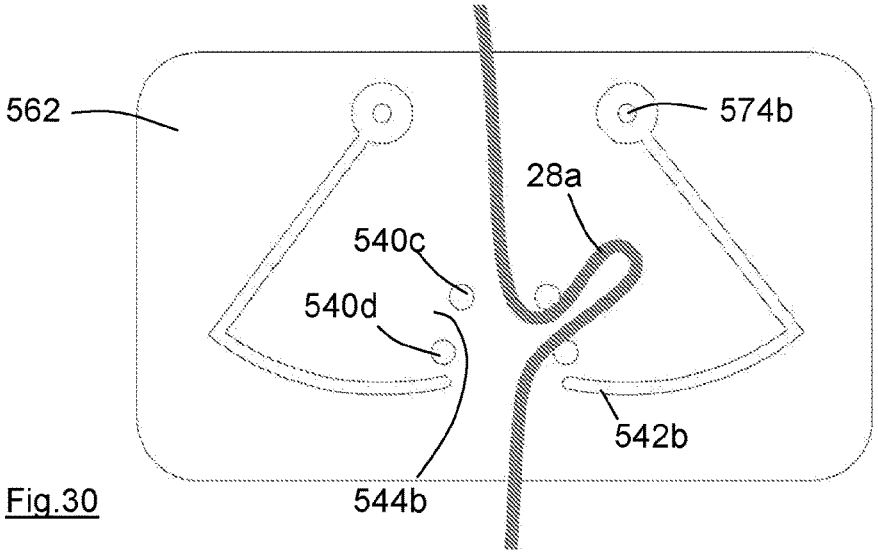
FIG. 30 shows a plan view of the fifth embodiment during a second stage of use.

A third and a fourth forming member 540*c* and 540*d* are also rigidly secured to the base plate 562, the gap between the third and fourth forming members providing a second hair-receiving region 544*b*. A second driving member 542*b* is pivotably mounted upon pivot peg 574*b* and can move from an inoperative position as seen in FIG. 30 to an operative position as seen in FIG. 31.

Figure 31:
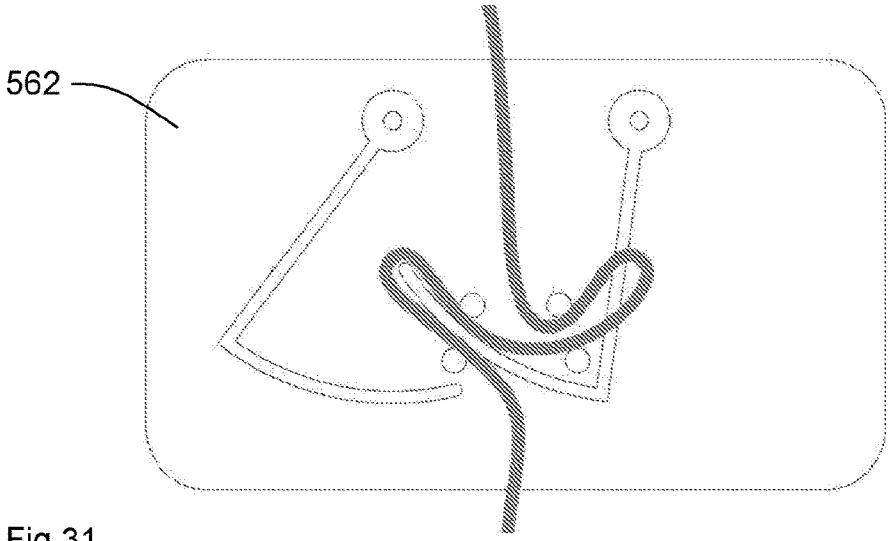
FIG. 31 shows a plan view of the fifth embodiment during a third stage of use.

The second driving member 542*b* is similarly configured to the first driving member 542*a* and can therefore drive another portion of the length of hair 28 into the second hair-receiving region 544*b* between the third and fourth forming members 540*c,d* as shown in FIG. 31.

Though not shown in these drawings, a resilient flap or flaps is provided between the first and second forming members 540*a* and 540*b* (and similarly between the third and fourth forming members 540*c* and 540*d*). The resilient flap does not prevent the passage of the driving member 542 nor the driving of a portion of the length of hair therethrough, but it does act to hold the portion of the length of hair once it has been pressed into the hair-receiving region. Thus, as the first driving member 542*a* is retracted back to its inoperative position as shown in FIG. 30, the portion 28*a* of the length of hair is retained by the resilient member(s) within the first hair-receiving region 544*a*. Alternatively, the first and second forming members could be resilient, or could be resiliently-mounted to move relative to the base, so as to allow the passage of the driving member but also to hold the portion(s) of hair therebetween.

Furthermore, as the second driving member 542*b* drives another portion 28*b* of the length of hair into the second hair-receiving region 544*b*, further hair is drawn into the device from the distal end 50 rather than any of the portion 28*a* being pulled back out of the first hair-receiving region.

Figure 32:
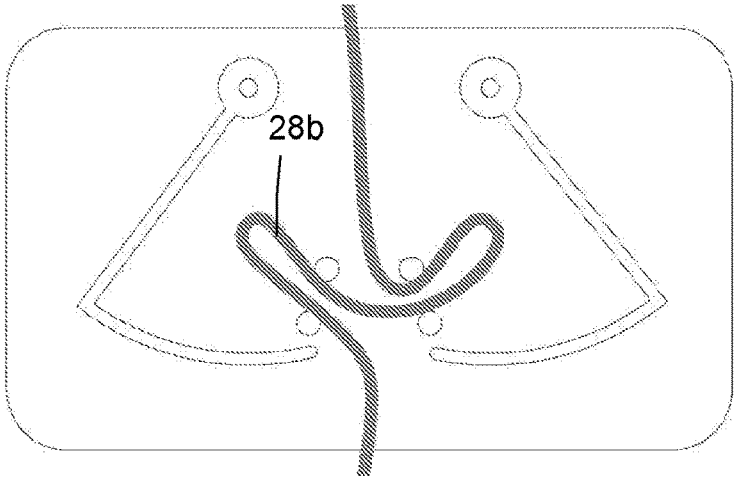

FIG. 32 shows the condition in which each of the driving members 542*a,b* has undertaken one cycle of operation, i.e. moving from its inoperative position to its operative position and back to its inoperative position. It will be understood that the sequence of operations can be repeated, with alternating movements of the first and second driving members, whereby to press further portions of the length of hair 28 into the first and second hair-receiving regions 544*a,b*.

It will be understood that in all of the embodiments the size of the waves which are produced depends upon the size (in particular the depth) of the hair-receiving regions, and especially the linear extent of each portion of the length hair which is pressed into the hair-receiving regions. Whilst it is sometimes desirable to produce large waves, it is understood that smaller waves are usually more aesthetic. Thus, the substantially linear portions of hair between the successive bends in a waved length of hair play little part in contributing to the pleasing appearance of the hair. The inventors therefore prefer to provide a device which can produce a large number of small waves, and thereby seek to provide devices having small hair-receiving regions which are closely spaced, whereby to reduce the linear extent of the length of hair between adjacent bends.

The inventors also seek to provide a hair styling device which can be used to add hair treatment products to the length of hair during the styling (waving) process. The hair treatment product can be steam, chemicals to condition or treat the length of hair, or a combination of both. Retaining the length of hair within a chamber is particularly beneficial for the addition of hair treatment products, and if the chamber is surrounded by substantially continuous walls the loss of those products to the environment can be minimised.

In particularly preferred embodiments, the chamber is heated directly, for example by incorporating heaters (preferably electrical heaters) into one or more of the walls of the chamber. Hair treatment products can be applied by way of ports communicating with the chamber. In particular, in an alternative to the second embodiment shown in FIGS. 12-18, the pivot pins 264 can be partially hollow so as to allow the passage of steam and/or a liquid or vaporised hair treatment product into the forming members and the driving members, those members having exit ports to allow the steam or product to pass into the chamber adjacent to the length of hair. The pivot pins 264 can be in fluid communication with a reservoir for water and/or a chosen hair treatment product within the body or handle of the device 10. Alternatively, the base plate 262 can have ports which are covered by the forming members and driving members when in their operative positions, the ports being adapted to deliver steam and/or hair treatment products into the forming and driving members, for subsequent dispersal to the length of hair.

The provision of ports within the chamber can be beneficial even for those embodiments designed for use without hair treatment products. Specifically, hot air can be blown into the chamber through the internal ports, ideally immediately adjacent to the contained length of hair. The hot air acts to heat the hair and speed up the styling process, and can if desired be the only means for heating the length of hair (although preferably the hot air would be additional to the heat applied by way of the heated walls of the chamber).

The embodiments shown can be used to provide a substantially consistent wave in the user's hair. Alternative wave forms can be provided by arranging the forming members and/or the driving members in a non-straight line (in their operative positions), or by changing the shape of, and/or the cross-sectional dimension of, and/or the spacing between, some of the forming members and driving members, as desired.

It will be understood that the length of waved hair can be removed from the device at the end of the waving process simply by pulling the length of hair from its proximal end. However, that is not preferred as much of the formed wave will be lost if the hair is placed under tension during the removal procedure, and in particular if the hair is forced to bend in opposition to the formed wave. Therefore, it is desired to move the forming members and/or driving members back to their inoperative positions, and to open the panel 20, in order to allow the substantially unencumbered removal of the waved length of hair from the device by way of the opening 22.

In preferred embodiments the device has a controller to control the movement of the driving member(s) and the other components of the device, for example the heating element(s). The controller may include a timer so that it can determine the duration of a hair waving operation, i.e. the heating element(s) is switched off after a certain period of time and a visual or audible signal is issued to the user to indicate that the chamber can be opened and the waved length of hair removed.

Chosen components of the device can issue feedback signals to the controller so that the controller can monitor the operation of the device. As above explained a sensor can be provided to indicate when the closure element is closed, the controller issuing the signal to commence the movement of the driving member(s) only when the sensor signal has been received. Another feedback signal can be issued by the motor which moves the driving member(s), it being recognised that a high load upon the motor might be indicative of hair entanglement, or that too much hair has been placed into the device. The controller can store a threshold load value and can stop (and perhaps reverse) the movement of the driving member(s) if the threshold is exceeded.

Also, the device may include means to determine the thickness of the length of hair which has been placed into the device, and the controller can store several sets of parameters (for example the temperature of the heater(s), the speed of movement of the driving member(s), and the duration of operation), and can determine the parameters to be used to wave a particular length of hair based upon the thickness of that length of hair.

The invention claimed is:

1. A hair styling device for imparting a wave to a length of hair, the device having:

a chamber for containing the length of hair, the device having an opening through which the length of hair may be introduced into the chamber, and a closure element for closing the opening, a plurality of forming members within the chamber, the plurality of forming members comprising at least a first forming member, a second forming member, a third forming member, and a fourth forming member, a first hair-receiving region between the first forming member and the second forming member, a second hair-receiving region between the second forming member and the third forming member, and a third hair-receiving region between the third forming member and the fourth forming member, a plurality of driving members comprising at least a first driving member, a second driving member, and a third driving member, the first driving member being movable relative to the first forming member between an inoperative position outside the first hair-receiving region and an operative position within the first hair-receiving region, the second driving member being movable relative to the second forming member between an inoperative position outside the second hair-receiving region and an operative position within the second hair-receiving region, the third driving member being movable relative to the third forming member between an inoperative position outside the third hair-receiving region and an operative position within the third hair-receiving region, in which the second driving member is movable relative to the first driving member, in which the third driving member is movable relative to the first and second driving members, in which the second driving member is adapted to move to its operative position only after the first driving member has moved to its operative position, and in which the third driving member is adapted to move to its operative position only after the second driving member has moved to its operative position, the device being electrically actuated with a controller which actuates the movements of the first driving member, the second driving member and the third driving member, the first driving member, the second driving member and the third driving member all being movable relative to the closure element, the controller actuating the first driving member, the second driving member and the third driving member to move to their respective operative positions only after the opening has been closed by the closure element.

2. A hair styling device according to claim 1, in which each of the plurality of driving members are identically formed, and in which each of the plurality of forming members are all identically formed, and in which there is a further hair-receiving region between the first and second driving members.

3. A hair styling device according to claim 1 in which the path of movement of each of the driving members between its inoperative and its operative positions is one of: {i} substantially linear, {ii} arcuate, and {iii} rotational.

4. A hair styling device according to claim 1 having at least one guideway which serves to guide a length of hair into the device.

5. A hair styling device according to claim 1 in which the chamber has at least one wall, and in which the at least one wall has a heater.

6. A hair styling device according to claim 1 in which the chamber is at least partly provided within a body which is mounted upon a first handle part, and in which the closure element is mounted on a second handle part, the first and second handle parts being movable relative to one another to define an open condition and a closed condition for the chamber.

7. A hair styling device according to claim 1 in which the controller actuates the first driving member to move to its operative position independently of the second driving member, and actuates the second driving member to move to its operative position independently of the third driving member.

* * * * *